US007063147B2

(12) United States Patent
Siebrits et al.

(10) Patent No.: US 7,063,147 B2
(45) Date of Patent: Jun. 20, 2006

(54) METHOD AND APPARATUS AND PROGRAM STORAGE DEVICE FOR FRONT TRACKING IN HYDRAULIC FRACTURING SIMULATORS

(75) Inventors: Eduard Siebrits, Stafford, TX (US); Anthony Peirce, Vancouver (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 205 days.

(21) Appl. No.: 10/831,799

(22) Filed: Apr. 26, 2004

(65) Prior Publication Data

US 2005/0236152 A1 Oct. 27, 2005

(51) Int. Cl.
*E21B 43/26* (2006.01)
*E21B 47/09* (2006.01)

(52) U.S. Cl. ..... 166/250.1; 166/308.1
(58) Field of Classification Search ..... 166/250.1, 166/308.1
See application file for complete search history.

(56) References Cited

U.S. PATENT DOCUMENTS

| | | | | |
|---|---|---|---|---|
| 5,050,674 | A * | 9/1991 | Soliman et al. | 166/250.1 |
| 6,834,233 | B1 * | 12/2004 | Economides et al. | 166/250.1 |
| 6,935,424 | B1 * | 8/2005 | Lehman et al. | 166/250.1 |
| 2004/0016541 | A1 * | 1/2004 | Detournay et al. | 166/250.1 |

OTHER PUBLICATIONS

Hirt, C.W. and Nichols, B.D., "Volume of fluid (VOF) method for the dynamics of free boundaries", J. of Computational Physics, 39, 201-225, 1981.
Luoma, J.A., "Development and applications of explicit numerical algorithms for analysis of free-surface problems in polymer molding processes", Ph.D. thesis, University of Minnesota, 1999.
Rider, W.J. and Kothe, D.B. "Reconstructing Volume Tracking", J. of Computational Physics, 141, 112-152, 1998.

(Continued)

*Primary Examiner*—Kenneth Thompson
(74) *Attorney, Agent, or Firm*—Thomas O. Mitchell; Tim Curington; Robin Nava

(57) ABSTRACT

A method and system and program storage device is adapted to continuously update a perimeter of a fracture footprint created in an Earth formation when a fracturing fluid fractures the formation penetrated by a wellbore. Two embodiments of a Volume of Fluid (VOF) software, adapted to be stored in a memory of a computer system, will locate the position of a fracture perimeter during the evolution of that fracture when the software is executed by the processor of the computer system. The two embodiments, called the 'Marker VOF (MVOF)' and the 'Full VOF (FVOF)' software, will continuously update the perimeter of the fracture footprint by updating a Fill Fraction for each tip element. The MVOF software will use a fill fraction mass balance integral equation to update the Fill Fraction for each tip element, and the FVOF software will use an integrated form of fluid flow equations to update the Fill Fraction for each tip element.

15 Claims, 13 Drawing Sheets

OTHER PUBLICATIONS

Rudman, M. "Volume tracking methods for interfacial flow calculations", Int. J. Numer. Method. in Fluids, subm., 1996.

Scardovelli, R. and Zaleski, S., "Analytical relations connecting linear interfaces and volume fractions in rectangular grids", J. of Computational Physics, 164, 228-237, 2000.

Swaminathan, C.R. and Voller, V.R., "A time-implicit filling algorithm", Appl. Math. Modelling, 18, Feb., 101-108, 1994.

Voller, V.R. and Chen, Y.F. "Prediction of filling times of porous cavities", Int. J. Num. Meth. Engrg., 23, 661-672, 1996.

Voller, V.R., Peng, S. and Chen. Y.F. "Numerical solution of transient, free surface problems in porous media", Int. J. Num. Meth. Engrg, 39, 2889-2906, 1996.

Voller, V.R. and Peng, S. "An algorithm for analysis of polymer filling of molds", Polymer Engrg and Sci. 35(22), 1759-65.

Voller, V.R., Detournay E. and Savitski A. "On A Couples Elastic-Fluid Problem With A Moving Boundary", Civil-Comp Press 2000 269-273.

Zhong Qi Yue and Jian-Hua Yin—*Backward Transfer-Matrix Method for Elastic Analysis of Layered Solids with Imperfect Bonding*—Journal of Elasticity 50: 109-128, 1998.

* cited by examiner

| Pumping Schedule | | |
|---|---|---|
| Min | Frac Fluid (bbls/min) | Proppant (bbls/min) |
| 100 | 15 | 5 |
| 200 | 10 | 10 |
| 300 | 10 | 10 |
| 400 | 10 | 10 |
| 500 | 20 | 0 |

82

50 50 48a2

$$F(i,j)=\begin{bmatrix}
0 & 0 & 0 & 0 & 0 & 0 & 0 & 0 & 0 & 0 & 0 & 0 & 0 & 0 \\
0 & 0 & 0 & 0 & 0 & 0 & 0 & 0 & 0 & 0 & 0 & 0 & 0 & 0 \\
0 & 0 & 0 & 0 & 0 & 0 & 0.01 & 0.014 & 0 & 0 & 0 & 0 & 0 & 0 \\
0 & 0 & 0 & 0 & 0.018 & 0.278 & 1 & 1 & 0.449 & 0.058 & 0 & 0 & 0 & 0 \\
0 & 0 & 0.879 & 0.39 & 1 & 1 & 1 & 1 & 1 & 1 & 0.327 & 0 & 0 & 0 \\
0 & 0.853 & 1 & 1 & 1 & 1 & 1 & 1 & 1 & 1 & 1 & 1 & 0.899 & 0 \\
0 & 0.063 & 1 & 1 & 1 & 1 & 1 & 1 & 1 & 1 & 1 & 1 & 0.435 & 0 \\
0 & 0.51 & 1 & 1 & 1 & 1 & 1 & 1 & 1 & 1 & 1 & 1 & 0.635 & 0 \\
0 & 0.063 & 1 & 1 & 1 & 1 & 1 & 1 & 1 & 1 & 1 & 1 & 0.435 & 0 \\
0 & 0.853 & 1 & 1 & 1 & 1 & 1 & 1 & 1 & 1 & 1 & 1 & 0.699 & 0 \\
0 & 0 & 0.879 & 0.39 & 1 & 1 & 1 & 1 & 1 & 1 & 0.327 & 0 & 0 & 0 \\
0 & 0 & 0 & 0 & 0.018 & 0.278 & 1 & 1 & 0.449 & 0.058 & 0 & 0 & 0 & 0 \\
0 & 0 & 0 & 0 & 0 & 0 & 0.01 & 0.014 & 0 & 0 & 0 & 0 & 0 & 0 \\
0 & 0 & 0 & 0 & 0 & 0 & 0 & 0 & 0 & 0 & 0 & 0 & 0 & 0
\end{bmatrix}$$

48a2 48a1 50 50

FIG. 20

METHOD AND APPARATUS AND PROGRAM STORAGE DEVICE FOR FRONT TRACKING IN HYDRAULIC FRACTURING SIMULATORS

BACKGROUND OF THE INVENTION

The subject matter of the present invention relates to hydraulic fracturing simulators adapted for use in the oil and gas industry, and, in particular, to a method and apparatus and program storage device for tracking of fracture fronts associated with a fracture footprint in hydraulic fracturing simulators.

Hydraulic fracturing simulators are routinely used in the oil and gas industry to design hydraulic fracturing (HF) jobs, monitor them in real time, and evaluate the results to improve future HF designs. Most oil wells and many gas wells are hydraulically fractured in order that such wells will become economic and efficient producers of underground deposits of hydrocarbon. There are different classes of HF simulators available in the industry, such as PKN, KGD, Radial, P3D, and PL3D models. These models contain different levels of complexity in their governing equations and each have their own applications. For example, P3D (or pseudo 3D) models are the current industry standard. However, these models have limitations and do not always provide a very accurate result. There is a move towards PL3D (or planar 3D) models in the industry. These Models are deemed to be state of the art and are significantly more accurate than the P3D models, but the PL3D models require complicated mathematical algorithms. There exists a need for improvements to the 'PL3D' model of Hydraulic Fracturing (HF) simulators. In this specification, one such improvement to the 'PL3D' model of HF simulators will be disclosed. In particular, that improvement to the 'PL3D' model lies within the 'Volume Of Fluid (VOF)' approach for tracking fracture fronts associated with fracture footprints in hydraulic fracturing simulators. In connection with the aforementioned improvement to the 'Volume of Fluid' or 'VOF' portion of the 'PL3D' model of HF simulators, a key challenge to developing an effective simulator is devising a robust and accurate algorithm to locate the unknown perimeter of the fracture within the fracture plane (which is termed the 'free boundary'). This specification will disclose two novel Local Volume of Fluid (LVOF) strategies for locating the position of a fracture perimeter during the evolution of that fracture.

In this specification, we will assume that the fluid front matches the fracture front, and that any 'lag' between the fluid front and the fracture front is negligible. The VOF approach here disclosed can also, with some alteration, be applied to tracking fronts between different fluids within the fracture, or to tracking the fluid front separately from the fracture front, thereby allowing for the calculation of a 'lag' between the fluid front and the fracture front. These possibilities form part of the spirit of this invention.

SUMMARY OF THE INVENTION

One aspect of the present invention involves a method of continuously updating a perimeter of a fracture footprint, the fracture footprint having a plurality of tip elements, comprising the steps of: updating a fill fraction for each tip element of the plurality of tip elements by using the following equation:

$$w_{k+1}F_{k+1}^{(j+1)} = w_k F_k - \frac{\Delta t_k}{A_e}\int_{\Gamma_e(t)} \underline{v}_{k+1}^{(j)} \cdot \underline{n}\,dl - G_e\left(F_{k+1}^{(j+1)}, t, t_0^e\right).$$

Another aspect of the present invention involves a program storage device readable by a machine storing a set of instructions executable by the machine to perform method steps for continuously updating a perimeter of a fracture footprint, the fracture footprint having a plurality of tip elements, the method steps comprising: updating a fill fraction for each tip element of the plurality of tip elements by using the following equation:

$$w_{k+1}F_{k+1}^{(j+1)} = w_k F_k - \frac{\Delta t_k}{A_e}\int_{\Gamma_e(t)} \underline{v}_{k+1}^{(j)} \cdot \underline{n}\,dl - G_e\left(F_{k+1}^{(j+1)}, t, t_0^e\right).$$

Another aspect of the present invention involves a system adapted for continuously updating a perimeter of a fracture footprint, said fracture footprint having a plurality of tip elements, comprising: apparatus adapted for updating a fill fraction for each tip element of the plurality of tip elements by using the following equation:

$$w_{k+1}F_{k+1}^{(j+1)} = w_k F_k - \frac{\Delta t_k}{A_e}\int_{\Gamma_e(t)} \underline{v}_{k+1}^{(j)} \cdot \underline{n}\,dl - G_e\left(F_{k+1}^{(j+1)}, t, t_0^e\right)$$

Another aspect of the present invention involves a method of continuously updating a perimeter of a fracture footprint, the fracture footprint having a plurality of tip elements, comprising the steps of: updating a fill fraction for each tip element of the plurality of tip elements by using the following equation:

$$F_{k+1}^{(j+1)} = F_k - \frac{\Delta t_k}{A_e}\int_{\Gamma_e(t)} \underline{v}_{k+1}^{(j)} \cdot \underline{n}\,dl.$$

Another aspect of the present invention involves a program storage device readable by a machine storing a set of instructions executable by the machine to perform method steps for continuously updating a perimeter of a fracture footprint, the fracture footprint having a plurality of tip elements, the method steps comprising: updating a fill fraction for each tip element of the plurality of tip elements by using the following equation:

$$F_{k+1}^{(j+1)} = F_k - \frac{\Delta t_k}{A_e}\int_{\Gamma_e(t)} \underline{v}_{k+1}^{(j)} \cdot \underline{n}\,dl.$$

Another aspect of the present invention involves a system adapted for continuously updating a perimeter of a fracture footprint, said fracture footprint having a plurality of tip elements, comprising: apparatus adapted for updating a fill fraction for each tip element of the plurality of tip elements by using the following equation:

$$F_{k+1}^{(j+1)} = F_k - \frac{\Delta t_k}{A_e} \int_{\Gamma_e(t)} \underline{v}_{k+1}^{(j)} \cdot \underline{n} dl.$$

One aspect of the present invention involves a method adapted for continuously updating a perimeter of a fracture footprint created in an Earth formation when a fracturing fluid fractures the formation penetrated by a wellbore, a mesh overlaying the fracture footprint defining a plurality of tip elements, comprising the steps of: (a) receiving input data including an old fill fraction F1 associated with the tip elements at an old time step 't1', an old pressure 'p1' associated with the tip elements at the old time step, and an old width 'w1' associated with the tip elements at the old time step; (b) incrementing the old time 't1' to a new time step 't2'; (c) solving for a new width 'w2' and a new pressure 'p2' associated with the tip elements at the new time step 't2' in response to the input data; (d) solving for a current new fill fraction 'F2' associated with the tip elements at the new time step 't2' by using the following equation:

$$w_{k+1} F_{k+1}^{(j+1)} = w_k F_k - \frac{\Delta t_k}{A_e} \int_{\Gamma_e(t)} \underline{v}_{k+1}^{(j)} \cdot \underline{n} dl - G_e\left(F_{k+1}^{(j+1)}, t, t_0^e\right);$$

(e) iterating the above equation by updating the current new fill fraction 'F2' (iteration 'j') to determine a latest new fill fraction 'F2' (iteration 'j+1') in response to a latest new value of 'w2' (iteration 'j+1') and a latest new value of 'p2' (iteration 'j+1'), (f) determining if the difference between the latest new fill fraction 'F2' (iteration 'j+1') and the current new fill fraction 'F2' (iteration 'j') is less than a particular tolerance; (g) repeating steps (e) and (f) when the difference between the latest new fill fraction 'F2' (iteration 'j+1') and the current new fill fraction 'F2' (iteration 'j') is not less than the particular tolerance; and (h) when the difference between the latest new fill fraction 'F2' (iteration 'j+1') and the current new fill fraction 'F2' (iteration 'j') is less than the particular tolerance, proceed to the next time step 't3' and repeat steps (a) through (g), where time 't2' replaces time 't1' and time 't3' replaces time 't2', and similarly for width and pressure values where width 'w2' replaces width 'w1', pressure 'p2' replaces pressure 'p1', and width 'w3' replaces width 'w2', pressure 'p3' replaces pressure 'p2'.

Another aspect of the present invention involves a program storage device readable by a machine storing a set of instructions executable by the machine to perform method steps for continuously updating a perimeter of a fracture footprint created in an Earth formation when a fracturing fluid fractures the formation penetrated by a wellbore, a mesh overlaying the fracture footprint defining a plurality of tip elements, the method steps comprising: (a) receiving input data including an old fill fraction F1 associated with the tip elements at an old time step 't1', an old pressure 'p1' associated with the tip elements at the old time step, and an old width 'w1' associated with the tip elements at the old time step; (b) incrementing the old time 't1' to a new time step 't2'; (c) solving for a new width 'w2' and a new pressure 'p2' associated with the tip elements at the new time step 't2' in response to the input data; (d) solving for a current new fill fraction 'F2' associated with the tip elements at the new time step 't2' by using the following equation:

$$w_{k+1} F_{k+1}^{(j+1)} = w_k F_k - \frac{\Delta t_k}{A_e} \int_{\Gamma_e(t)} \underline{v}_{k+1}^{(j)} \cdot \underline{n} dl - G_e\left(F_{k+1}^{(j+1)}, t, t_0^e\right);$$

(e) iterating the above equation by updating the current new fill fraction 'F2' (iteration 'j') to determine a latest new fill fraction 'F2' (iteration 'j+1') in response to a latest new value of 'w2' (iteration 'j+1') and a latest new value of 'p2' (iteration 'j+1'), (f) determining if the difference between the latest new fill fraction 'F2' (iteration 'j+1') and the current new fill fraction 'F2' (iteration 'j') is less than a particular tolerance; (g) repeating steps (e) and (f) when the difference between the latest new fill fraction 'F2' (iteration 'j+1') and the current new fill fraction 'F2' (iteration 'j') is not less than the particular tolerance; and (h) when the difference between the latest new fill fraction 'F2' (iteration 'j+1') and the current new fill fraction 'F2' (iteration 'j') is less than the particular tolerance, proceed to the next time step 't3' and repeat steps (a) through (g), where time 't2' replaces time 't1' and time 't3' replaces time 't2', and similarly for width and pressure values where width 'w2' replaces width 'w1', pressure 'p2' replaces pressure 'p1', and width 'w3' replaces width 'w2', pressure 'p3' replaces pressure 'p2'.

Another aspect of present invention involves a method adapted for continuously updating a perimeter of a fracture footprint created in an Earth formation when a fracturing fluid fractures the formation penetrated by a wellbore, a mesh overlaying the fracture footprint defining a plurality of tip elements, comprising the steps of: (a) receiving input data including an old fill fraction F1 associated with the tip elements at an old time step 't1', an old pressure 'p1' associated with the tip elements at the old time step, and an old width 'w1' associated with the tip elements at the old time step; (b) incrementing the old time 't1' to a new time step 't2'; (c) solving for a new width 'w2' and a new pressure 'p2' associated with the tip elements at the new time step 't2' in response to the input data; (d) solving for a current new fill fraction 'F2' associated with the tip elements at the new time step 't2' by using the following equation:

$$F_{k+1}^{(j+1)} = F_k - \frac{\Delta t_k}{A_e} \int_{\Gamma_e(t)} \underline{v}_{k+1}^{(j)} \cdot \underline{n} dl;$$

(e) iterating the above equation by updating the current new fill fraction 'F2' (iteration 'j') to determine a latest new fill fraction 'F2' (iteration 'j+1') in response to a latest new value of 'w2' (iteration 'j+1') and a latest new value of 'p2' (iteration 'j+1'), (f) determining if the difference between the latest new fill fraction 'F2' (iteration 'j+1') and the current new fill fraction 'F2' (iteration 'j') is less than a particular tolerance; (g) repeating steps (e) and (f) when the difference between the latest new fill fraction 'F2' (iteration 'j+1') and the current new fill fraction 'F2' (iteration 'j') is not less than the particular tolerance; and (h) when the difference between the latest new fill fraction 'F2' (iteration 'j+1') and the current new fill fraction 'F2' (iteration 'j') is less than the particular tolerance, proceed to the next time step 't3' and repeat steps (a) through (g), where time 't2' replaces time 't1' and time 't3' replaces time 't2', and similarly for width and pressure values where width 'w2' replaces width 'w1', pressure 'p2' replaces pressure 'p1', and width 'w3' replaces width 'w2', pressure 'p3' replaces pressure 'p2'.

Another aspect of the present invention involves a program storage device readable by a machine storing a set of instructions executable by the machine to perform method steps for continuously updating a perimeter of a fracture footprint created in an Earth formation when a fracturing fluid fractures the formation penetrated by a wellbore, a mesh overlaying the fracture footprint defining a plurality of tip elements, the method step comprising: (a) receiving input data including an old fill fraction F1 associated with the tip elements at an old time step 't1', an old pressure 'p1' associated with the tip elements at the old time step, and an old width 'w1' associated with the tip elements at the old time step; (b) incrementing the old time 't1' to a new time step 't2'; (c) solving for a new width 'w2' and a new pressure 'p2' associated with the tip elements at the new time step 't2' in response to the input data; (d) solving for a current new fill fraction 'F2' associated with the tip elements at the new time step 't2' by using the following equation:

$$F_{k+1}^{(j+1)} = F_k - \frac{\Delta t_k}{A_e} \int_{\Gamma_e(t)} \underline{v}_{k+1}^{(j)} \cdot \underline{n} dl;$$

(e) iterating the above equation by updating the current new fill fraction 'F2' (iteration 'j') to determine a latest new fill fraction 'F2' (iteration 'j+1') in response to a latest new value of 'w2' (iteration 'j+1') and a latest new value of 'p2' (iteration 'j+1'), (f) determining if the difference between the latest new fill fraction 'F2' (iteration 'j+1') and the current new fill fraction 'F2' (iteration 'j') is less than a particular tolerance; (g) repeating steps (e) and (f) when the difference between the latest new fill fraction 'F2' (iteration 'j+1') and the current new fill fraction 'F2' (iteration 'j') is not less than the particular tolerance; and (h) when the difference between the latest new fill fraction 'F2' (iteration 'j+1') and the current new fill fraction 'F2' (iteration 'j') is less than the particular tolerance, proceed to the next time step 't3' and repeat steps (a) through (g), where time 't2' replaces time 't1' and time 't3' replaces time 't2', and similarly for width and pressure values where width 'w2' replaces width 'w1', pressure 'p2' replaces pressure 'p1', and width 'w3' replaces width 'w2', pressure 'p3' replaces pressure 'p2'.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 20 illustrates one example of the Fill Fraction Matrix Output that is generated by the recorder or display device of the computer system of FIG. 11 which corresponds in principle to the mesh shown in FIG. 19.

DETAILED DESCRIPTION

Figure 1:
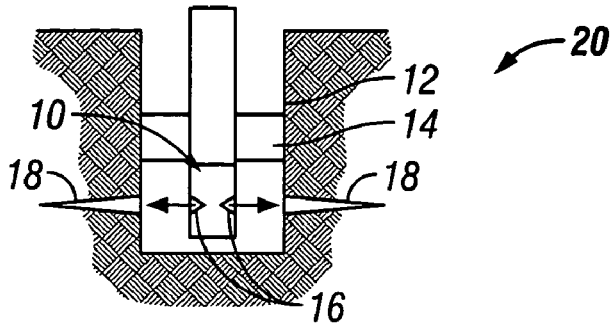
FIGS. 1 through 3 illustrate a typical Hydraulic Fracturing (HF) job in a wellbore.

As noted earlier, this specification discloses an improvement to the Volume of Fluid or 'VOF' portion of the 'PL3D' model of Hydraulic Fracture (HF) simulators. In that improvement, a robust and accurate software, known as the 'Local Volume of Fluid (LVOF) software', is disclosed which will locate an unknown perimeter of a fracture within a fracture plane (also called a 'free boundary'). Two embodiments of the 'Local Volume of Fluid (LVOF) software' (or 'LVOF Software') of the present invention are disclosed herein, each embodiment of the 'LVOF software' being adapted for locating the position of a fracture perimeter in a formation penetrated by a wellbore during the evolution of that fracture in the formation when a Hydraulic Fracturing (HF) job is performed at a wellbore for the purpose of fracturing the formation penetrated by the wellbore.

An essential functional step in Hydraulic Fracturing (HF) design associated with the VOF software of the present invention is to be able to track the interfaces between different fluid types. This allows us to achieve an optimum injection schedule for the HF job. In addition, the actual fracture front must be carefully tracked. The fluid injection schedule usually contains a number of different fluids, pumped sequentially. The HF model needs to be able to track the boundaries between different fluids as they move inside the hydraulic fracture, and simulator equations can be developed to track the boundaries between the different fluids. This can be accomplished in a very simple yet powerful way by making use of the VOF approach. This approach has never been used in HF simulators. In addition, the VOF approach can be used to track the actual fracture boundary, again, in a very simple yet powerful way. This avoids the commonly used technique of particle marker methods, which discretely track individual points along the fracture front. Such methods are extremely difficult to implement in a numerical simulator, and require sophisticated book-keeping algorithms.

In this specification, a unique form of the 'Volume of Fluid (VOF) software' is used, which is also called the 'Local Volume of Fluid (LVOF)' software. The 'VOF software' of the present invention serves to automatically determine the current location of a hydraulic fracture footprint as part of a hydraulic fracturing simulation for use in modeling a hydraulic fracture treatment. Such a model can, in principle, be used in real-time to continuously update the treatment design based on incoming data collected from pressure data, seismics, tiltmeters, etc.

The HF system disclosed in this specification, which includes the 'VOF software' of the present invention, includes surface equipment [pump trucks, blenders, monitoring trucks, data storage devices, personal computer (PCs), software, etc] installed at the well site. A hydraulic fracturing treatment is performed on the well, and all measured data is fed back to the surface and stored on data storage devices (e.g., PC hard disks). Software installed on the PCs is used to simulate the hydraulic fracturing treatment process, based on input data supplied from the pumping schedule, formation properties, earth stresses, and well casing and tubing dimensions, well orientation, and perforation data. The hydraulic fracturing software consists of typical software to model the growth of the hydraulic fracture, possibly in real time, as the job is pumped, after completion of the job for later back-analysis, or before the job is pumped for design purposes. Outputs include the projected fracture footprint (i.e., fracture dimensions) at any stage of the treatment, as well as data on the fracture width and fracture pressure at all locations along the fracture surface.

The 'VOF software' (also known as the Local Volume of Fluid or LVOF software) of the present invention is used in connection with a computer system to monitor the estimated footprint of the fracture surface at any stage of the treatment. The 'VOF software' is simple, robust, and efficient because it is based on the principle of mass balance; in addition, it uses a scalar 'filling fraction' (where the 'filling fraction' is hereinafter denoted by the letter 'F') to numerically track the fracture outline at any stage of the treatment.

The 'VOF software' of the present invention works in the following way: a numerical mesh, consisting of elements or cells, is set up to cover an area larger than the maximum expected fracture footprint at the end of the treatment. Each cell is assigned a 'filling fraction' of unity (F=1) if the cell is fractured and filled with fracturing fluid, or a 'filling fraction' of zero (F=0) if the cell is unfractured, or a fractional 'filling fraction' value (0<F<1) if the cell is 'partially fractured'. A 'partially fractured' cell implies that the fracture tip passes through that cell. Specialized contouring software can then be used to interpolate the fracture front location from the discrete values of 'F' in each cell. The 'Volume of Fluid software' or 'VOF software' of the present invention is based on mathematical expressions of mass balance (set forth later in this specification). When the 'VOF software' of the present invention is executed by a processor of a computer system, only the cells that make up the perimeter of the fracture footprint are needed to update the perimeter of the fracture footprint (or only the cells that make up the boundary between adjacent fluids are needed to update the boundaries between different fluids as they move inside the hydraulic fracture) in the LVOF scheme.

Figure 8:
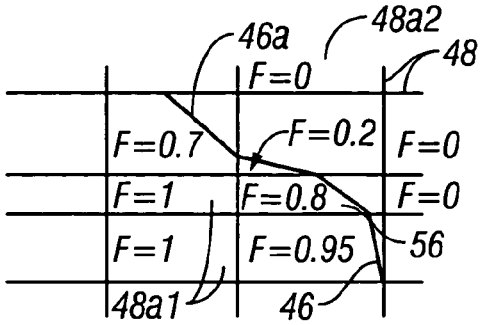
Figure 9:
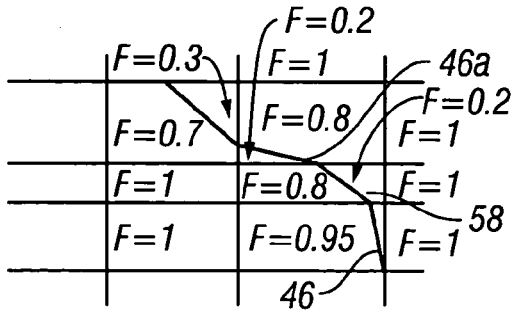

If we wish to track either fluid fronts inside the HF (between different fluid types) or the actual fracture front, the 'LVOF method', which utilizes the 'VOF software' of the present invention, can be utilized. If we wish to track fronts between different fluids, a variation of the VOF method is needed but the same basic concepts apply as are outlined in this invention. The 'LVOF method' practiced by the 'VOF software' of the present invention uses VOF equations in a slightly modified form, such that a filling fraction 'F' is introduced in each element of the numerical mesh but only the elements that contain a fluid/fluid boundary in the case of multiple fluids or the fracture front boundary are needed in the method. The filling fraction 'F' is a scalar quantity, and it ranges between zero and unity. An empty element or cell in the mesh contains no fluid and is represented by a 'filling fraction' of F=0; however, a completely filled element or cell is represented by a 'filling fraction' of F=1. If 0<F<1 occurs in an element or cell of the mesh (e.g., F=0.3), this implies that the element or cell of the mesh is partially filled with fracturing fluid. Similarly, if we wish to track fluid fronts inside the HF (between adjacent fluid types), then the fill fractions can be used to define the boundary between two different fluid types. Multiple fronts can be tracked simultaneously in a Hydraulic Fracture (HF) by appropriate combinations of multiple filling fractions 'F'. In FIGS. 8 and 9, FIG. 8 shows a fracture front interpolated from local filling fractions 'F', whereas FIG. 9 shows a fluid/fluid interface interpolated from local filling fractions 'F'.

The following 'VOF method' represents a basic construction of the 'VOF software' in accordance with the present invention:

TIME STEP LOOP
UPDATE TIME STEP
VOF ITERATION LOOP
i. SOLVE FOR COUPLED PRESSURE AND HF WIDTH
ii. CALCULATE LATEST FILLING FRACTIONS F AT EACH ELEMENT IN HF
iii. UPDATE FRACTURE FRONT BY INTERPOLATION OF ALL F VALUES
iv. CHECK FOR GLOBAL CONVERGENCE OF F
NEXT VOF ITERATION
NEXT TIME STEP The strength of the above 'VOF method' practiced by the 'VOF software' of the present invention is its simplicity. A scalar quantity (trivial to implement in a simulator) is all that is required to track a complicated fracture boundary or fluid front.

Referring to FIG. 1, a perforating gun 10 is disposed in a wellbore 12 and a packer 14 isolates a plurality of shaped charges 16 of the perforating gun 10 downhole in relation to the environment uphole. The shaped charges 16 detonate and a corresponding plurality of perforations 18 are produced in a formation 20 penetrated by the wellbore 12.

Figure 2:
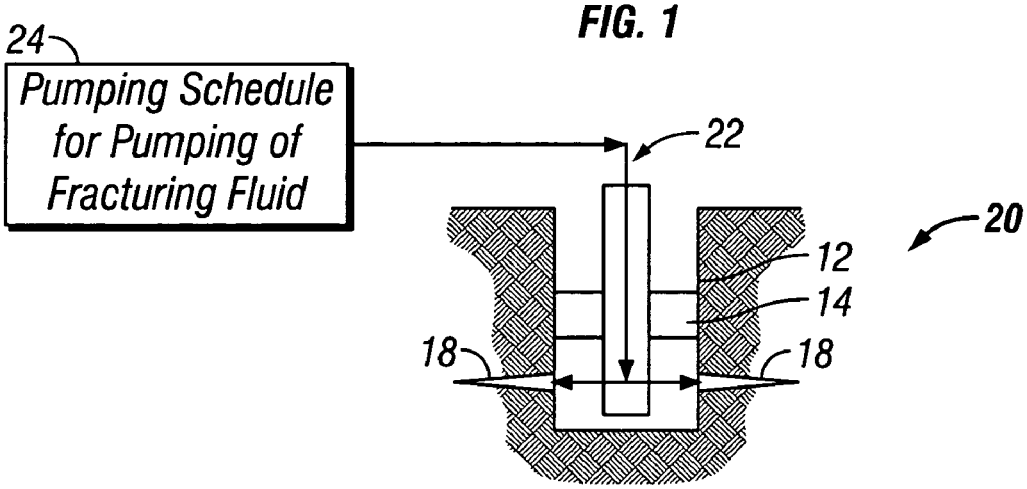

Referring to FIG. 2, when the formation 20 is perforated, a fracturing fluid 22 is pumped downhole into the perforations 18 in accordance with a particular pumping schedule 24. In response thereto, the formation 20 surrounding the perforations 18 is fractured.

Figure 3:
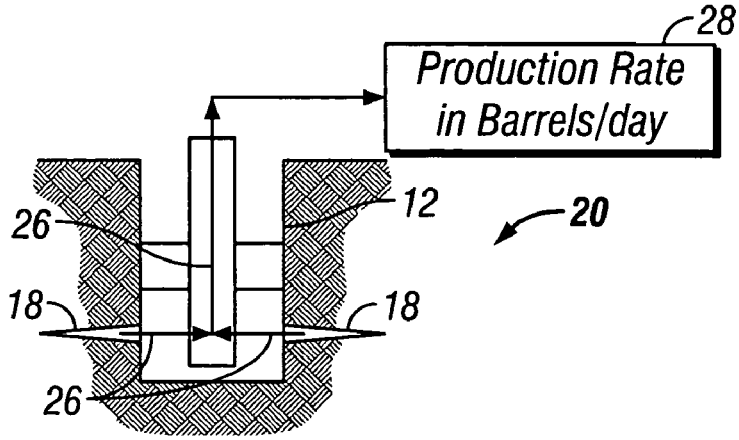

Referring to FIG. 3, when the formation 20 surrounding the perforations 18 is fractured, oil or other hydrocarbon deposits 26 begin to flow from the fractures, into the perforations 18, into the wellbore 12, and uphole to the surface. The oil or other hydrocarbon deposits flow at a certain 'production rate' 28 (e.g., in barrels/day).

Figure 4:
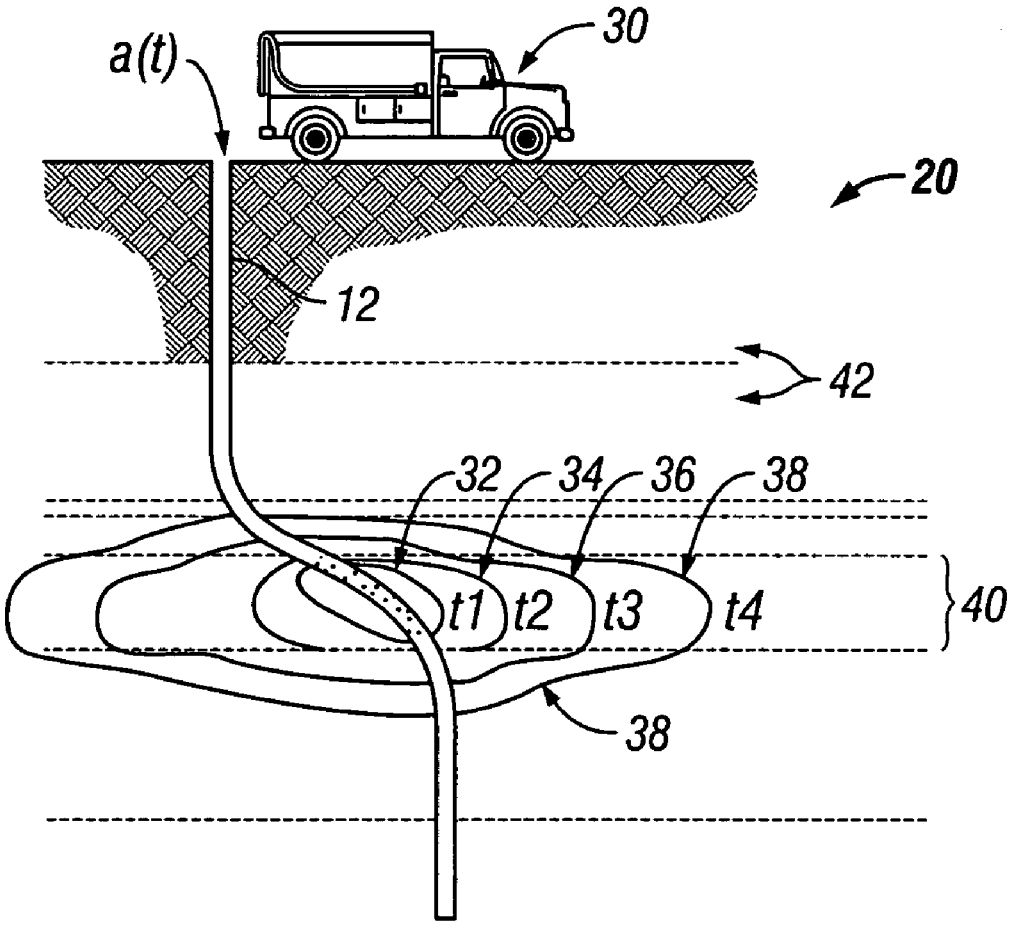
FIGS. 4 through 6 illustrate the fracture footprint created in the formation penetrated by the wellbore when the HF job is pumped.

Referring to FIG. 4, when the wellbore 12 of FIG. 2 is fractured, a pump truck 30 situated at the surface of the wellbore will pump fracturing fluid down a tubing and into the perforations 18 in the formation 20 penetrated by the wellbore, as shown in FIG. 2. The formation 20 includes different layers, such as the different layers 42, one such layer being a perforated interval 40. In response thereto, at time t1, a first fracture footprint 32 will be formed in the perforated interval 40 (and possibly in additional adjacent intervals 42) of a formation 20 penetrated by the wellbore 12. At time t2, a second fracture footprint 34 will be formed in the perforated interval 40 (and possibly in additional intervals 42) of a formation 20 penetrated by the wellbore 12. At time t3, a third fracture footprint 36 will be formed in the perforated interval 40 (and possibly in additional intervals 42) of a formation 20 penetrated by the wellbore 12. At time t4, a fourth fracture footprint 38 will be formed in the perforated interval 40 (and possibly in additional intervals 42) of a formation 20 penetrated by the wellbore 12.

Figure 5:
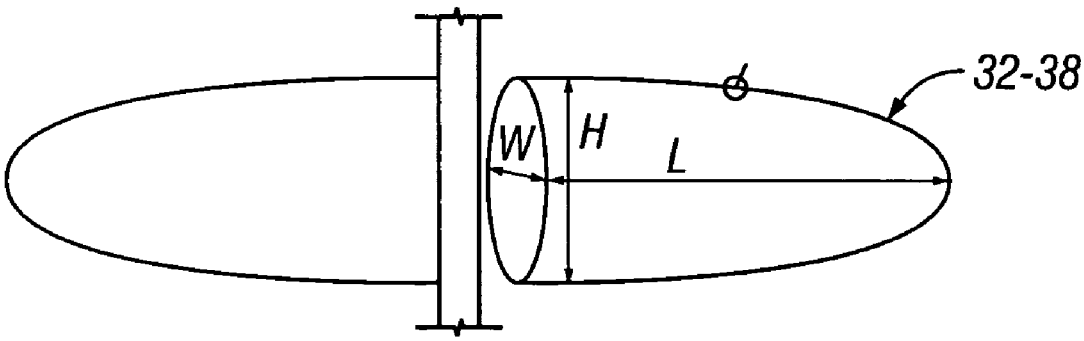
Figure 6:
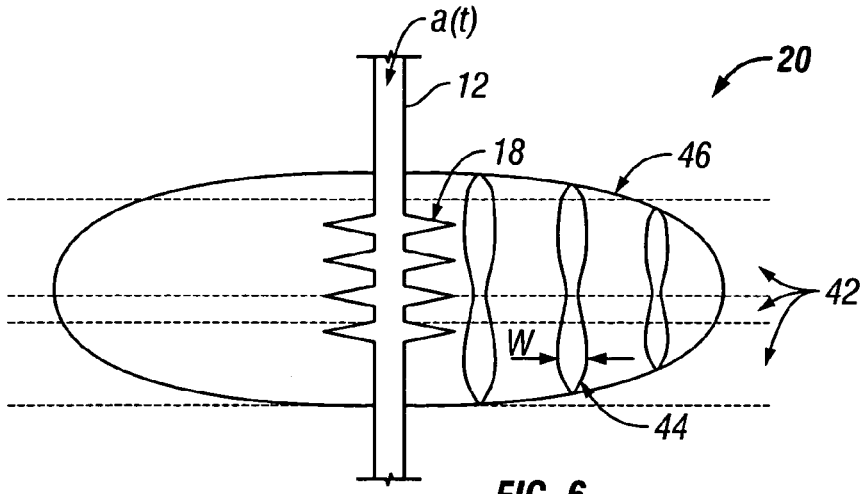

Referring to FIGS. 5 and 6, referring initially to FIG. 5, a schematic three dimensional view of a fracture footprint, such as the fracture footprints 32–38 of FIG. 4, is illustrated. In FIG. 5, each fracture footprint 32–38 has a length 'L' and a height 'H' and a width 'w'. In FIG. 6, the wellbore 12 is illustrated again, and a plurality of perforations 18 are created in the formation 20 penetrated by the wellbore 12, as illustrated in FIGS. 1–3. As noted in FIG. 4, the formation 20 includes a plurality of different layers 42. In FIG. 6, when the pump trucks 30 of FIG. 4 pump the fracturing fluid into the perforations 18, a 'fracture footprint' 46 is created in the formation 20 which is similar to the fracture footprints 32, 34, 36, and 38 shown in FIG. 4 that are created, respectively, over the different periods of time t1, t2, t3, and t4. Note that the 'fracture footprint' 46 in FIG. 6 has a cross section 44, the cross section 44 having a fracture width 'w' similar to the width 'w' of the fracture footprint 32–38 shown in FIG. 5.

Figure 7:
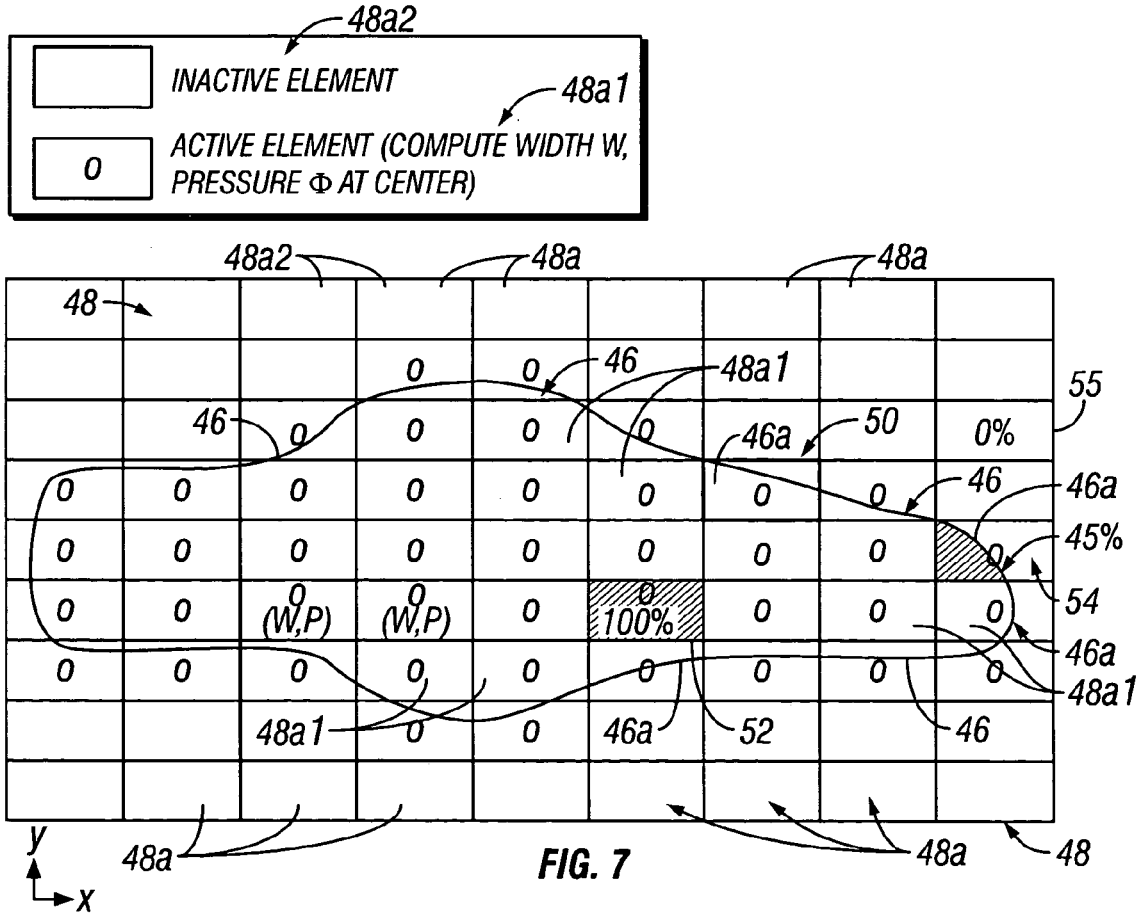
FIGS. 7 through 9 illustrate how a mesh comprised of a plurality of grid cells will overlay on top of the fracture footprint of FIGS. 4 through 6, each grid cell of the mesh having a width and pressure, some of the grids cells called 'tip elements' being intersected by a perimeter of the fracture footprint, the tip elements having a width and a pressure (w, p), a portion of each tip element having fracturing fluid disposed therein.

Referring to FIG. 7, recalling the fracture footprint 46 shown in FIG. 6, in FIG. 7, a mesh 48 comprised of a plurality of grid-elements 48*a* or grid cells 48*a* is illustrated. In FIG. 7, the mesh 48 is overlayed over the top of the fracture footprint 46 of FIG. 6. The mesh 48 includes a plurality of active elements or active grid cells 48*a*1 and a plurality of inactive elements or inactive grid cells 48*a*2. The active grid cells 48*a*1 will overlay the fracture footprint 46, whereas the inactive grid cells 48*a*2 will not overlay the fracture footprint 46. Each of the active grid elements or grid cells 48*a*1 of the mesh 48 have a width 'w' and a pressure 'p' assigned thereto, denoted by the symbol: (w, p). Therefore, each active grid cell 48*a*1 of the mesh 48 has a width/pressure value (w, p) assigned to that active grid cell. In FIG. 6, since the fracturing fluid propagating down the wellbore 12 enter the perforations 18 and create the fracture footprint 46, in FIG. 7, each of the active grid cells 48*a*1 in the mesh 48 have a fracturing fluid disposed therein. In FIG. 7, there are two types of active grid cells 48*a*1: (1) an active grid cell 48*a*1 which is intersected by a perimeter 46*a* of the fracture footprint 46, and (2) an active grid cell 48*a*1 which is not intersected by the perimeter 46*a* of the fracture footprint 46. An active grid cell 48*a*1 that is intersected by the perimeter 46*a* of the fracture footprint 46 is known as a 'tip element'. For example, in FIG. 7, 'tip element' 50 is an active grid cell 48*a*1 that is intersected by the perimeter 46*a* of the fracture footprint 46. An active grid cell 48*a*1 which is not intersected by the perimeter 46*a* of the fracture footprint 46 has a volume which is wholly occupied by the fracturing fluid (i.e., 100% of the active grid cell is occupied by the fracturing fluid), where the fracturing 'fluid' may or may not include proppant. For example, in FIG. 7, active grid cell 52 is not intersected by the perimeter 46*a* of the fracture footprint 46 and its area is wholly occupied by the fracturing fluid (100% of the area of the active grid cell 52 is occupied by fracturing fluid). However, an active grid cell 48*a*1 that is intersected by the perimeter 46*a* (i.e., a 'tip element') is occupied by 'less than 100%' of the fracturing fluid. For example, the active grid cell or 'tip element' 54 is intersected by the perimeter 46*a* of the fracture footprint 46, however, only 45% of the area of the active grid cell 54 is occupied by the fracturing fluid. In comparison, an inactive grid cell 48*a*2, such as inactive grid cell 55, has a volume which is wholly devoid of any fracturing fluid (0% of the area of the inactive grid cell 55 is occupied by fracturing fluid).

The 'VOF software' of the present invention will calculate, over a series of time steps, the 'amount of fracturing fluid that is contained within each of the active grid cells 48*a*1 that are intersected by the perimeter 46*a* of the fracture footprint 46'; that is, the 'VOF software' of the present invention will calculate, over the series of time steps, the 'amount of fracturing fluid that is contained within each of the tip elements 50'. The 'amount of fracturing fluid that is contained within each of the tip elements 50' is calculated from the 'fill fraction', the 'fill fraction' being denoted by the letter 'F'. For example, in FIG. 7, the 'fill fraction' F for the 'tip element' 54 is 45%. Therefore, the 'VOF software' of the present invention will calculate, over a series of time steps, the 'fill fraction' (F) for each of the 'active grid cells 48*a*1 of the mesh 48 that are intersected by the perimeter 46*a* of the fracture footprint 46'; that is, the 'VOF software' will calculate, over the series of time steps, the 'fill fraction' (F) for each of the 'tip elements' 50 of the mesh 48 of FIG. 7. As a result, by calculating the 'fill fraction' (F) for each of the 'tip elements' 50 over a series of time steps, the amount or degree by which the perimeter 46*a* of the footprint 46 of the fracture is expanding (or contracting), as a result of the pumping of the fracturing fluid into the perforations 18 in the formation 20 by the pump trucks 30 of FIG. 4, can be determined.

Referring to FIGS. 8 and 9, two more examples of a mesh 48 similar to the mesh 48 of FIG. 7 is illustrated. In FIG. 8, a mesh 48 is illustrated as overlaying the fracture footprint 46 having a perimeter 46*a*. Fracturing fluid is disposed inside the perimeter 46*a*, but the fracturing fluid is not disposed outside the perimeter 46*a*. In FIG. 8, since the inactive grid cell 48*a*2 is disposed outside the perimeter 46*a*, there is no fracturing fluid disposed inside the inactive grid cell 48*a*2 and, therefore, the 'fill fraction' F associated with the inactive grid cell 48*a*2 of FIG. 8 is 'zero' (F=0). In FIG. 8, the active grid cells 48*a*1 are disposed wholly within the perimeter 46*a* (i.e., the perimeter 46*a* does not intersect the active grid cells 48*a*1); therefore, the entire area (i.e., 100%) of the active grid cells 48*a*1 are occupied by fracturing fluid and, as a result, the 'fill fraction' F associated with the active grid cells 48*a*1 in FIG. 8 is '1' (F=1). However, in FIG. 8, let us analyze the active grid cell 56. The active grid cell 56 is intersected by the perimeter 46*a* and, as a result, 80% of the area of the active grid cell 56 is occupied by the fracturing fluid; therefore, the 'fill fraction' F for the active grid cell 56 is 0.8 (F=0.8). In FIG. 9, the 'VOF software' of the present invention can also calculate the volume of an active grid cell occupied by a first type of fluid and the volume of that same active grid cell occupied by a second type of fluid. For example, active grid cell 58 includes a first volume of 80% occupied by a first type of fluid, and a second volume of 20% occupied by a second type of fluid. The 'VOF software' of the present invention will calculate, over a series of time steps, the 'fill fraction' (F) for each of the 'active grid cells 48*a*1 that are intersected by the perimeter 46*a* of the fracture footprint 46' in the mesh 48; that is, the 'VOF software' will calculate, over the series of time steps, the 'fill fraction' (F) for each of the 'tip elements' in the mesh 48 shown in FIGS. 7, 8, and 9. As a result, the amount or degree by which the perimeter 46*a* of the footprint 46 is expanding (or contracting), in response to the pumping of fracturing fluid into the perforations 18, can be determined.

Figure 10:
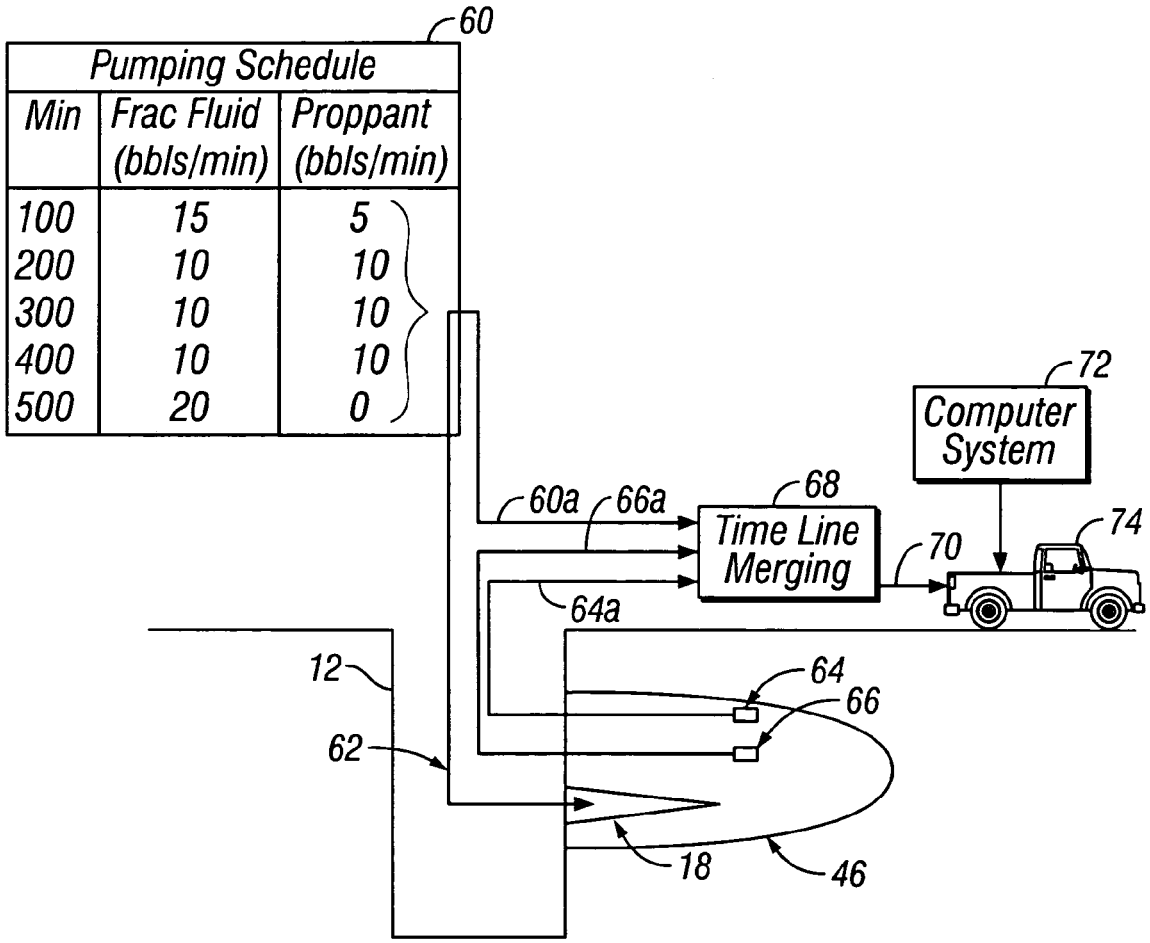
FIG. 10 illustrates the apparatus used in connection with a Hydraulic Fracturing (HF) job for fracturing a formation penetrated by a wellbore, the apparatus including a computer system for storing a software called a 'Volume of Fluid' software in accordance with one aspect of the present invention.

Referring to FIG. 10, the pump trucks 30 of FIG. 4 will pump a fracturing fluid 62 (frac fluid and proppant 62) down the wellbore 12 of FIG. 4 in accordance with a pumping schedule 60 (an example used in connection with this discussion). The fracturing fluid 62 will enter the perforations 18, and, responsive thereto, create a 'fracture footprint' 46, similar to the fracture footprint 46 shown in FIG. 6. Micro-seismic data sensor(s) 64 and tiltmeter data or other sensor(s) 66 will monitor the approximate geometry of the fracture footprint 46 and, responsive thereto, the sensor(s) 64 and 66 will generate output signals, the micro-seismic data sensor(s) 64 generating a micro-seismic data output signal 64*a*, the tiltmeter data sensor(s) 66 generating a tiltmeter data output signal 66*a*, and the pumping schedule 60 generating a pumping schedule output signal 60*a* representative of the pumping schedule 60. The pumping schedule output signal 60*a*, the tiltmeter data output signal 66*a*, and the micro-seismic data output signal 64*a* are time line merged via a 'time line merging' step 68. In this 'time line merging' step 68, the pumping schedule output signal 60*a*, the tiltmeter data output signal 66*a*, and the micro-seismic data output signal 64*a* are 'time synchronized' in a particular manner such that the tiltmeter data output signal(s) 66*a* and the micro-seismic data output signal(s) 64*a* synchronized with the times present in the pumping schedule 60. When the 'time line merging' step 68 is complete, a 'time line merged pumping schedule and tiltmeter data and micro-seismic data' output signal 70 is generated which is provided as 'input data' to a 'computer system' 72 disposed within a truck 74 situated at the site of the wellbore 12, such as a monitoring truck 74 or a 'FracCAT vehicle' 74.

Figure 11:
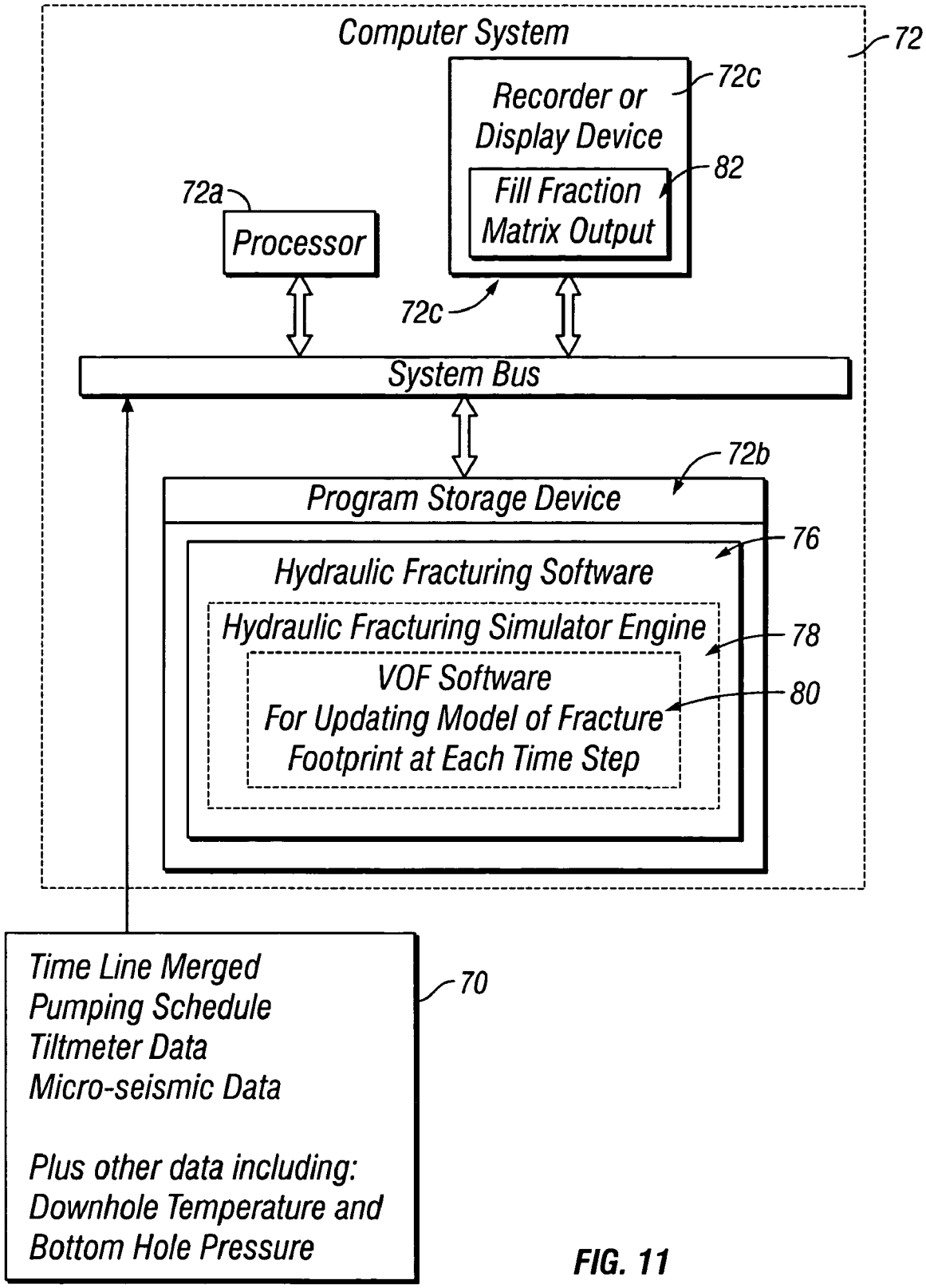
FIG. 11 illustrates the computer system of FIG. 10 which stores the 'Volume of Fluid' software in accordance with one aspect of the present invention.

Referring to FIG. 11, the 'computer system' 72 which is disposed within the truck 74, such as the 'FracCAT vehicle' 74, is illustrated. In FIG. 11, recall that the 'time line merged pumping schedule and tiltmeter data and micro-seismic data' output signal 70 of FIG. 10 is provided as 'input data' to the computer system 72 disposed within the truck 74, the output signal 70 being comprised of a time line merged pumping schedule and tiltmeter data and micro-seismic data plus other data including downhole temperature and bottom hole pressure. The computer system 72 includes a processor 72*a*, a memory or other program storage device 72*b*, and a recorder or display device 72*c*. The memory or other program storage device 72*b* stores the following software (76, 78, and 80) which is available from Schlumberger Technology Corporation of Houston, Tex.: a Hydraulic Fracturing Software 76 which includes a Hydraulic Fracturing Simulator Engine 78 which further includes a VOF software 80 in accordance with the present invention. The Hydraulic Fracturing Software 76 which includes a Hydraulic Fracturing Simulator Engine 78 which further includes a VOF software 80 can be initially stored on a CD-Rom, where that CD-Rom is also a 'program storage device'. That CD-Rom is then inserted into the computer system 72, and, then, the Hydraulic Fracturing Software 76 which includes a Hydraulic Fracturing Simulator Engine 78 which further includes a VOF software 80 of the present invention can be loaded from the CD-Rom into the memory/program storage device 72*b* of the computer system 72 of FIG. 11. The VOF software 80 in accordance with the present invention will be described in detail in the following paragraphs with reference to FIGS. 12–20. However, the Hydraulic Fracturing software 76 and the Hydraulic Fracturing simulator engine 78 are available from Schlumberger Technology Corporation of Houston, Tex. The processor 72*a* will execute the Hydraulic Fracturing Software 76 which includes a Hydraulic Fracturing Simulator Engine 78 which further includes a VOF software 80 and, responsive thereto, the recorder or display device 72*c* will generate a 'Fill Fraction Matrix Output' 82. An example of the 'Fill Fraction Matrix Output' 82 is shown in FIG. 20 of the drawings. The computer system 72 may be a personal computer (PC), a workstation, or a mainframe. Examples of possible workstations include a Silicon Graphics Indigo 2 workstation or a Sun SPARC workstation or a Sun ULTRA workstation or a Sun BLADE workstation. The memory or program storage device 72*b* is a computer readable medium or a program storage device which is readable by a machine, such as the processor 72*a*. The processor 72*a* may be, for example, a microprocessor, microcontroller, or a mainframe or workstation processor. The memory or program storage device 72*b*, which stores the VOF software 80 along with the Hydraulic Fracturing software 76 and the Hydraulic Fracturing Simulator engine 78, may be, for example, a hard disk, ROM, CD-ROM, DRAM, or other RAM, flash memory, magnetic storage, optical storage, registers, or other volatile and/or non-volatile memory.

Figure 12:
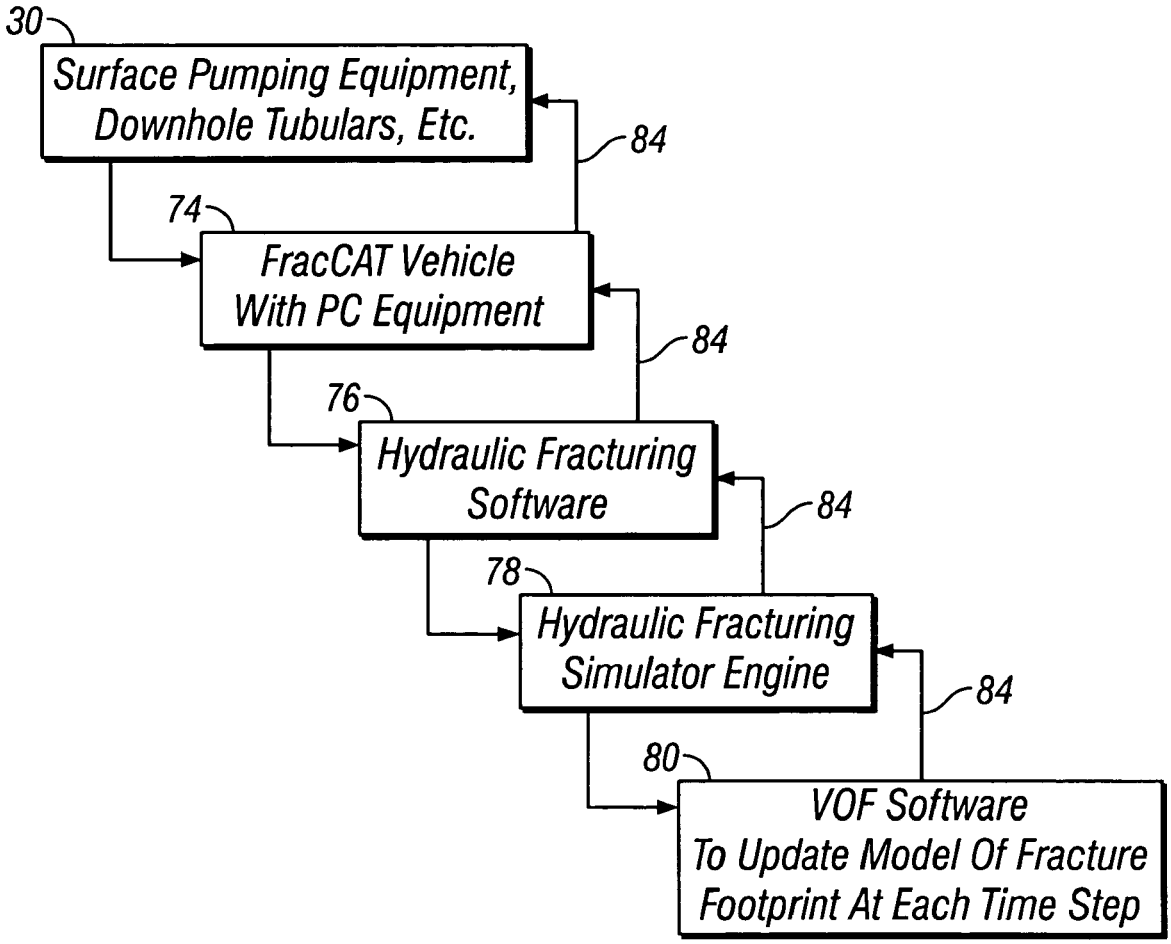
FIG. 12 illustrates the functional operation performed by the apparatus illustrated in FIG. 10 which is adapted for implementing the HF job that fractures the formation penetrated by the wellbore.

Referring to FIG. 12, the pump trucks 30 of FIG. 4 (which includes the downhole tubulars, etc) will pump the fracturing fluid 62 of FIG. 10 down the wellbore 12. Responsive thereto, the computer system 72 (such as the PC Equipment 72 which is disposed within FracCAT vehicle truck 74 of FIG. 10) will receive the 'time line merged pumping schedule and tiltmeter data and micro-seismic data' output signal 70 of FIG. 10. In response thereto, the processor 72*a* of the computer system 72 will execute the VOF software 80 of the present invention (which is included within the Hydraulic Fracturing Simulator engine 78 which is further included within the Hydraulic Fracturing software 76), and, as a result, the 'Fill Fraction Matrix Output' 82, such as the Matrix Output 82 shown in FIG. 20 of the drawings, will be generated by the recorder or display device 72*c*. Feedback loops 84 are included in FIG. 12 to illustrate the feedback of data and other information from blocks 74, 76, 78, and 80.

Figure 13:
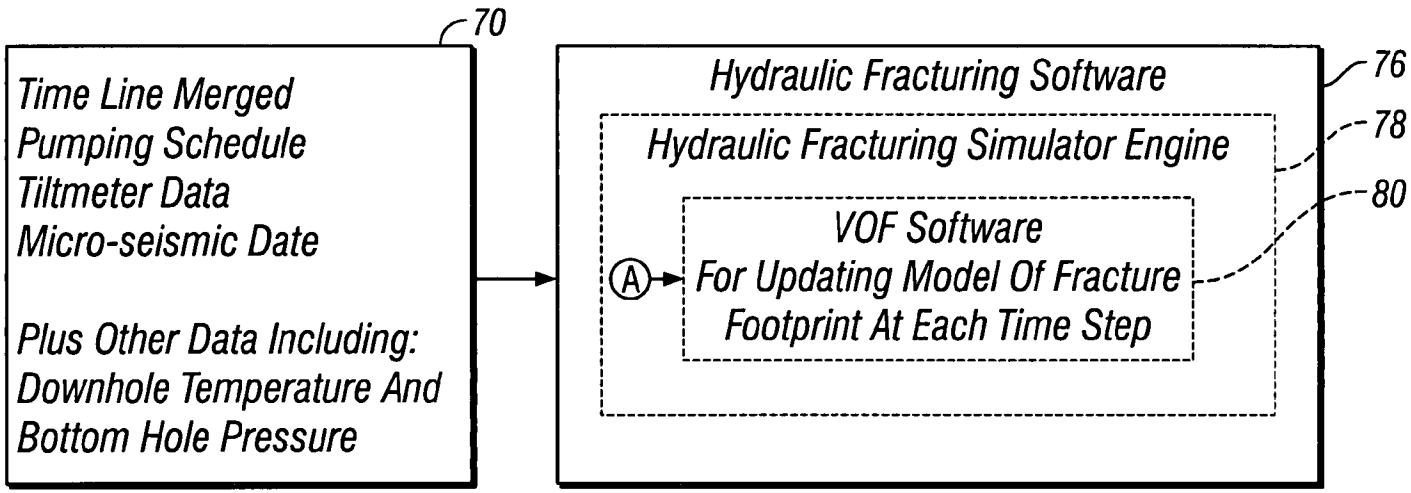
FIGS. 13 and 14 illustrate the software stored in the memory of the computer system of FIG. 11, a portion of that software including the 'Volume of Fluid' software in accordance with one aspect of the present invention that is responsive to certain input data including: the current time, the fill fracture (F), the pressure (p), and the width (w) of each grid cell of the mesh shown in FIG. 7.

Referring to FIG. 13, recall from FIG. 11 that the 'time line merged pumping schedule and tiltmeter data and micro-seismic data' output signal 70 of FIG. 10 is provided as 'input data' to the computer system 72 disposed within the truck 74, the output signal 70 being comprised of a time line merged pumping schedule and tiltmeter data and micro-seismic data plus other data including downhole temperature and bottom hole pressure. In fact, the 'time line merged pumping schedule and tiltmeter data and micro-seismic data' output signal 70 is provided as 'input data' to the Hydraulic Fracturing software 76 and the Hydraulic Fracturing simulator engine 78. The Hydraulic Fracturing simulator engine 78 will receive the 'time line merged pumping schedule and tiltmeter data and micro-seismic data' output signal 70 and, responsive thereto, the Hydraulic Fracturing simulator engine 78 will generate 'other data' 86 which will be provided as 'input data' 86 to the VOF software 80.

Figure 14:
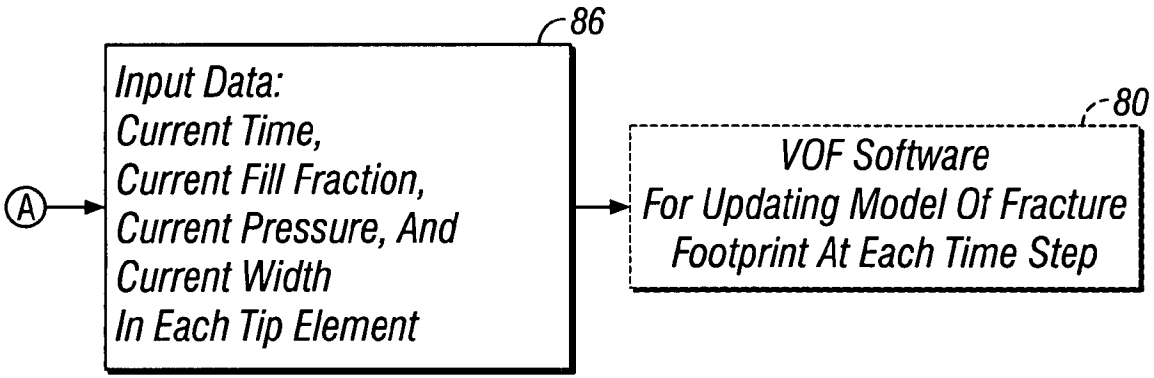

Referring to FIG. 14, that 'other data' 86 which is generated by the Hydraulic Fracturing simulator engine 78 and which is provided as 'input data' 86 to the VOF software 80 is illustrated in FIG. 14. In FIG. 14, the 'input data' 86 which is provided to the VOF software 80 includes the following 'data and information' 86 (shown in block 86 in FIG. 14) pertaining to each 'tip element' 50 of FIG. 7: (1) the current time step, (2) the current Fill Fraction in each 'tip element' 50, (3) the current pressure in each 'tip element' 50, and (4) the current width of each 'tip element' 50. The VOF software 80 will receive the 'data and information' 86 set forth in block 86 in FIG. 14 and, responsive thereto, the VOF software 80 will generate the Fill Fraction Matrix Output 82 which is recorded or displayed on the recorder or display device 72*c* of the computer system 72 of FIG. 11.

Referring to FIGS. 15, 16, 17, and 18, a detailed construction of the 'VOF software' 80 in accordance with the present invention, which is adapted to be stored in the program storage device 72*b* of the computer system 72, is illustrated.

Figure 15:
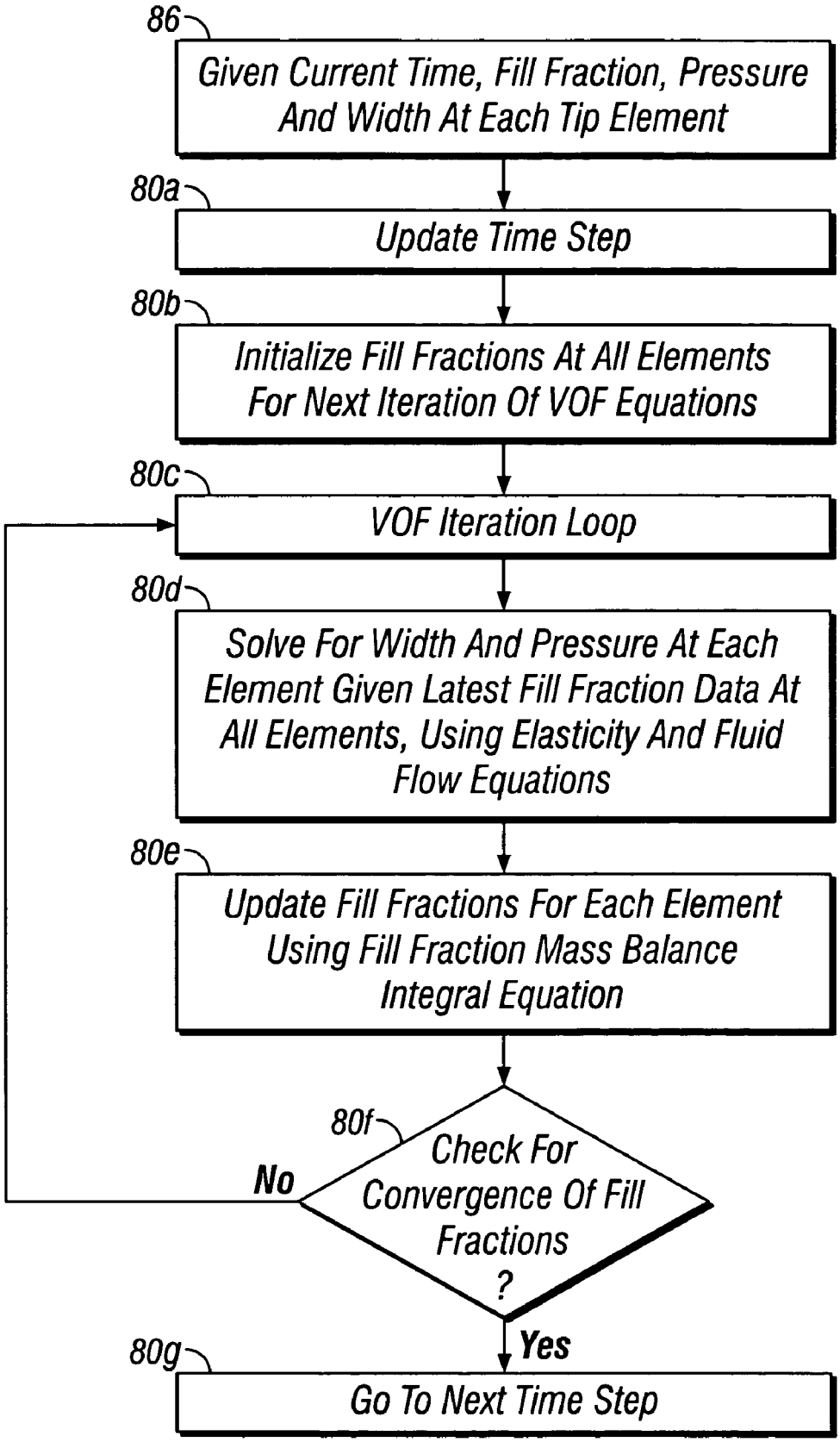
FIGS. 15 and 16 illustrate one embodiment of the 'Volume of Fluid' software of FIGS. 11, 13, and 14 called the Marker VOF or MVOF.
Figure 16:
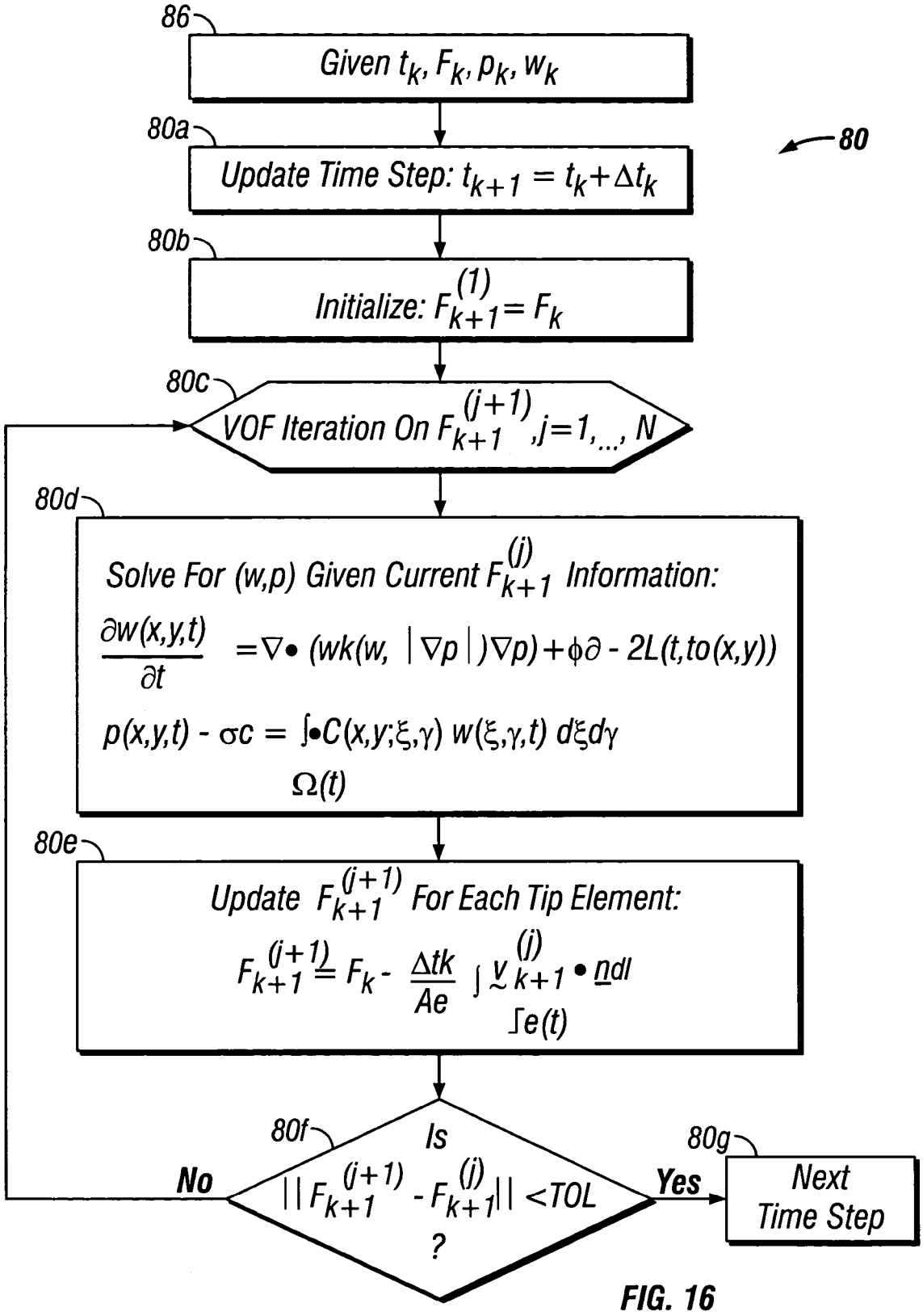
Figure 17:
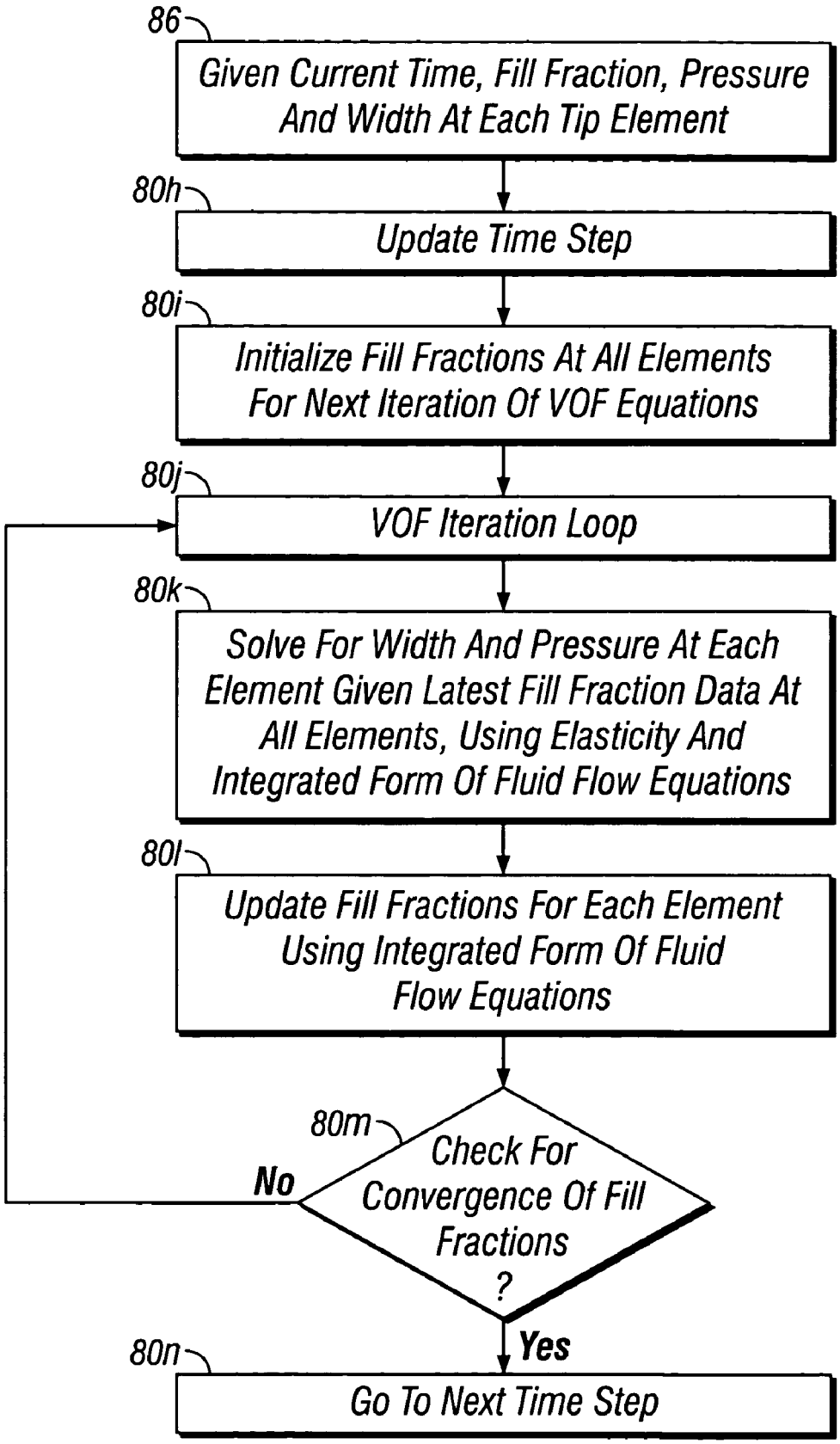
FIGS. 17 and 18 illustrate another embodiment of the 'Volume of Fluid' software of FIGS. 11, 13, and 14 called the Full VOF or FVOF.
Figure 18:
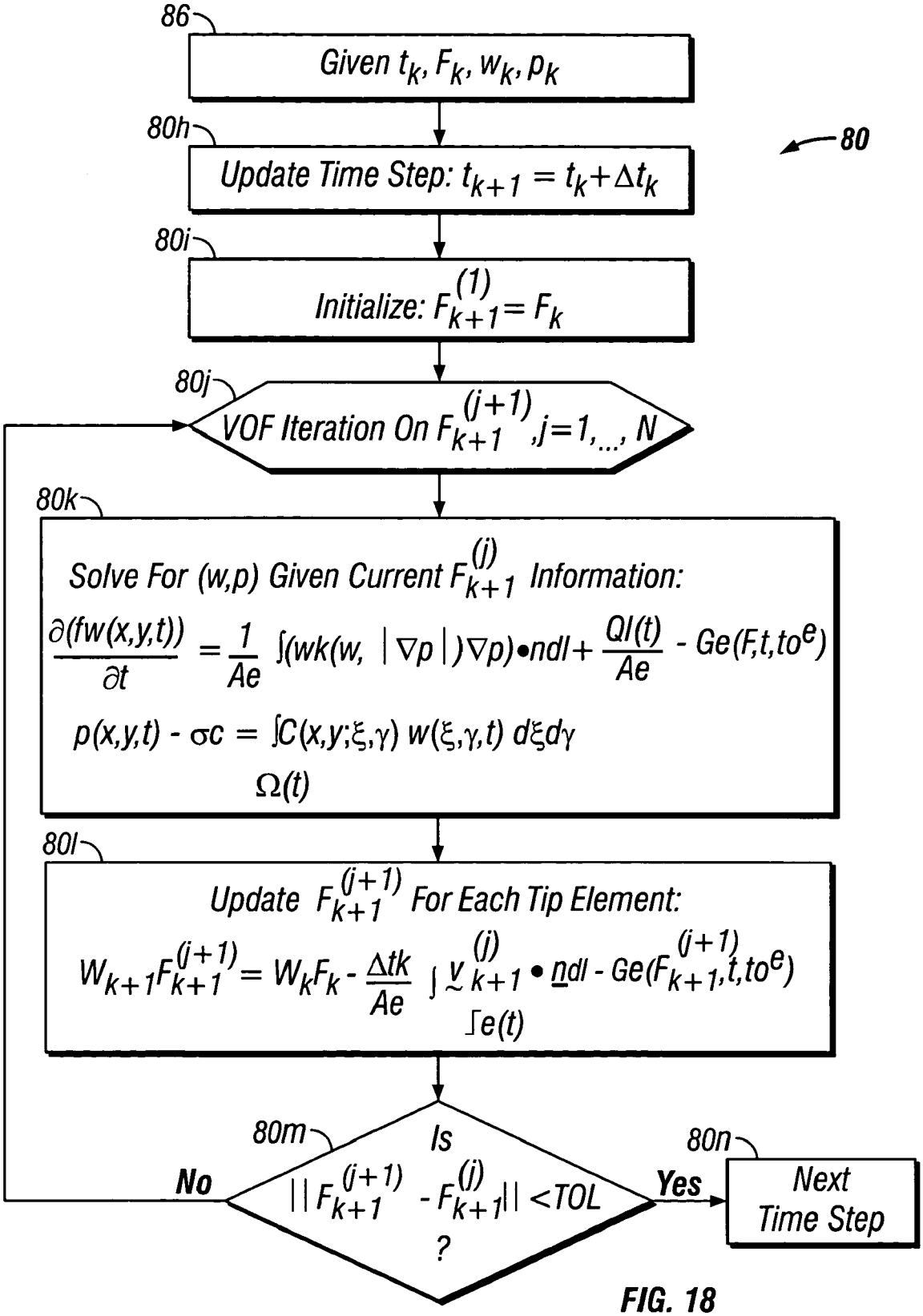

Before discussing FIGS. 15 and 16 dealing with the 'Marker VOF' or (MVOF) approach and FIGS. 17 and 18 dealing with the 'Full VOF' or (FVOF) approach associated with the 'VOF software' 80, the following discussion relating to 'time stepping and classic VOF', the 'MVOF', and the 'FVOF' will assist the reader in understanding the principles behind the 'VOF software' 80 in accordance with the present invention.

The 'VOF software' 80 is adapted for simulating the evolution of a fluid driven fracture in a porous layered elastic medium. The fracture is assumed to develop within a planar region. A key challenge to developing an effective simulator is devising a robust and accurate software adapted for locating the unknown perimeter of the fracture within the fracture plane (which is termed the free boundary). This specification discloses two novel Volume of Fluid (VOF) strategies adapted for locating the position of a fracture perimeter as the fracture evolves, the 'Marker VOF' and the 'Full VOF'.

Time Stepping and Classic VOF

In order to simulate the fracture evolution over the time interval [0, T] of interest, the time interval is divided into subintervals of duration $\Delta t_k$. The fracture front is evolved from one time step to the next by a recursive process by which the fracture footprint is assumed to be known at time $t_k$ and we wish to determine the location of the fracture perimeter at a subsequent time step $t_{k+1}=t_k+\Delta t_k$. If the fracture footprint is known, and if the amount of fluid that has been pumped into the fracture and the stiffness of the layered elastic medium is known, then it is possible to determine the fracture opening or width 'w' and the pressure distribution 'p' within the fracture. Given the pressure and width distribution within the fracture at any given time, it is possible to determine the fluid (i.e., fluid and proppant) velocity with which points within the fracture are moving. This velocity can then be used to determine the location of the fracture footprint at the current time-step.

The VOF method makes use of this velocity field in order to determine the evolution of the fracture perimeter. The classic VOF algorithm was designed to determine the evolution of a free boundary given a velocity field v, by considering the solution of the following partial differential equation:

$$\frac{\partial F}{\partial t} + \underline{v} \cdot \nabla F = 0$$

where F is the "fill fraction field", which is defined to be area fraction of an element (in this case, of rectangular shape) that is filled with fluid (see FIG. 8).

MVOF and FVOF

The two embodiments of the VOF software disclosed in this specification are coupled in a particular way to the fluid flow and elasticity equations. A first VOF scheme will be called the 'Marker VOF' or (MVOF). The first VOF scheme known as (MVOF) makes use of a fictitious marker fluid to evolve the fracture front in a way that is consistent with the velocity field. In the MVOF scheme, the updates of the Fill Fraction or 'F' field are performed only at 'tip elements' 50. A second VOF scheme will be called the 'Full VOF' or (FVOF). The second VOF scheme known as FVOF, which is necessary to model fractures growing in a porous medium in a numerically smooth way, requires that the VOF equations be coupled in a novel way with the fluid flow equations. The VOF equation that determines the front position in this FVOF formulation represents the fill fraction of the actual fluid that is being used to drive the front. Since the actual fluid is represented in the dynamical equation for the fill fraction, it is possible to include the sink terms that represent the fluid lost to the porous medium through the faces of the fracture. This formulation leads to substantially smoother results since the VOF equation is able to respond directly to the fluid loss. The fluid conservation equation that is used to determine the pressure distribution within the fracture for this VOF formulation depends explicitly on the fill fraction field (F).

Marker VOF or (MVOF)

For the MVOF, the governing fluid flow and elasticity equations are:

$$\frac{\partial w(x, y, t)}{\partial t} = \nabla \cdot (wk(w, |\nabla p|)\nabla p) + Q\delta - 2L(t, t_0(x, y))$$

$$p(x, y, t) - \sigma_c = \int_{\Omega(t)} C(x, y; \varepsilon, \eta) w(\varepsilon, \eta, t) d\varepsilon d\eta$$

where t is the current time, w is the current fracture width, p is the current fluid pressure in the fracture, δ is the Dirac delta function, Q is the current fluid injection rate, $\sigma_c$ is the local confining stress acting on the fracture, L( ) is a sink term denoting the leakoff from each fracture face into the surrounding reservoir, and $t_0(x, y)$ is the time at which the fluid front first passes location (x, y) in the fracture. Here, we assume that the plane contributing to the fracture is the (x, y) plane, and that the fracture region is denoted by Ω(t). In addition, we have also assumed, for simplicity only, that the fluid injection occurs at a point source as denoted by the Dirac delta function, but that this representation can easily be extended to a line source. The MVOF update equation assumes that the velocity field $\underline{v}=-k(w,|\nabla p|)\nabla p$ is known from the above two equations and the elemental marker fill fraction update at time $t_{k+1}$ is given by $$F_{k+1}^{(j+1)} = F_k - \frac{\Delta t_k}{A_c}\int_{\Gamma_e(t)} \underline{v}_{k+1}^{(j)} \cdot \underline{n} dl$$

In the above, $k(w,|\nabla p|)$ is a fracture "permeability" coefficient, applicable to either Newtonian or non-Newtonian fluids. Subscripts k and k+1 denote the kth and (k+1)st time steps, respectively, and superscripts (j) and (j+1) denote the jth and (j+1)st VOF iterations, respectively. The integral is performed along the tip element perimeter $\Gamma_e(t)$ which includes the fracture front crossing the element and the sides of the element exposed to filled fluid.

Full VOF or (FVOF)

For the FVOF, the governing fluid flow and elasticity equations are:

$$\frac{\partial(Fw(x,y,t))}{\partial t} = \frac{1}{A_e}\int_{\Gamma_e(t)} (wk(w,|\nabla p|)\nabla p)\cdot \underline{n} dl + \frac{Q(t)}{A_e} - G_e(F,t,t_0^e)$$

$$p(x,y,t) - \sigma_c = \int_{\Omega(t)} C(x,y;\varepsilon,\eta)w(\varepsilon,\eta,t)d\varepsilon d\eta$$

Here the fluid flow equation has been written in an integrated form where the region of integration in this case is a rectangular element having an area $A_e$ and a boundary $\Gamma_e(t)$. The term $G_e(F,t,t_0^e)$ represents the integral of the sink term $F(x,y,t)L(t,t_0^e(x,y))$ over the possibly partially filled element. Here $t_0^e$ refers to the trigger time at which the fluid first enters the element. In addition, we have also assumed, for simplicity only, that the fluid injection occurs at a point source, but that this representation can easily be extended to a line source. The FVOF update equation assumes that $w^{k+1(j)}$ and $p_{k+1}^{(j)}$ are known by solving the above two equations assuming that the fill fraction F is known. Thus the velocity field $v_{k+1}^{(j)}=-k(w_{k+1}^{(j)},|\nabla p_{k+1}^{(j)}|)\nabla p_{k+1}^{(j)}$ is known and the corresponding elemental fluid fill fraction update is given by $$w_{k+1}F_{k+1}^{(j+1)} = w_k F_k - \frac{\Delta t_k}{A_e}\int_{\Gamma_e(t)} \underline{v}_{k+1}^{(j)} \cdot \underline{n} dl - G_e\left(F_{k+1}^{(j+1)}, t, t_0^e\right)$$

In this FVOF formation, note the intrinsic coupling between the fill fraction update equation and the fluid flow equation.

Referring to FIGS. 15 and 16, a first embodiment of the 'VOF software' 80 in accordance with the present invention is illustrated. This first embodiment is known as the 'Marker VOF' or (MVOF) method. FIGS. 15 and 16 are intended to be read concurrently together, FIG. 15 including the steps of the (MVOF) method, FIG. 16 including the equations adapted for implementing each of the steps of the (MVOF) method of FIG. 15.

Recall from previous portions of this specification that the VOF software 80 practices a 'VOF method'. The following coding method, called the 'VOF method', represents a basic construction of the 'VOF software' 80 in accordance with the present invention:

VOF Method
- TIME STEP LOOP
- UPDATE TIME STEP
- VOF ITERATION LOOP
  - i. SOLVE FOR COUPLED PRESSURE AND FRAC WIDTH
  - ii. CALCULATE LATEST FILLING FRACTIONS F AT EACH ELEMENT IN HF
  - iii. UPDATE FRACTURE FRONT BY INTERPOLATION OF ALL F VALUES
  - iv. CHECK FOR GLOBAL CONVERGENCE OF F
- NEXT VOF ITERATION
- NEXT TIME STEP With respect to the above referenced 'VOF method' which represents a basic construction of the 'VOF software' 80 in accordance with the present invention, recall from FIGS. 6, 7, 8, and 9 that a fracturing fluid 62 enters the perforations 18 in the earth formation and creates a fracture footprint 46 where the fracture footprint 46 has a perimeter **46*a*. The 'tip elements' 50 of the fracture footprint 46 (those active grid cells 48*a*1 in FIG. 7 which are intersected by the perimeter 46*a* of the footprint 46) will expand and/or contract in response to the fracturing fluid 62 entering the perforations 18. As noted earlier, the function of the VOF software 80 of the present invention is to 'update the model of the fracture footprint 46 at each time step', that is, to continuously update, at each time step, the fracture footprint 46 (and, in particular, the perimeter 46*a* of the fracture footprint 46) in response to the expansion and/or contraction of the perimeter 46*a* of the footprint 46 when the fracturing fluid 62 enters the perforations 18 in the Earth's formation 20 (for the purpose of fracturing the formation and producing the oil and other hydrocarbon deposits 26 of FIG. 3). In order to continuously update the perimeter 46*a* at each 'new' time step, in a first iteration loop involving a 'new' time step, a previously known 'current' time step is given, and a previously known 'current' fill fraction for each 'tip element' 50 is given, and a previously known 'current' pressure for each 'tip element' 50 is given, and a previously known 'current' width for each 'tip element' 50 is given. Since we know the 'current' fill fraction, and the 'current' pressure, and the 'current' width at the 'current' time step for each 'tip element' 50 of the fracture footprint 46, we can now calculate: (1) a 'new' pressure (p) for each 'tip element' 50 at a 'new' time step, and (2) a 'new' width (w) for each 'tip element' 50 at the 'new' time step. Knowing the 'new' width and the 'new' pressure '(w, p)', we can then calculate a 'new' fill fraction (F) for each 'tip element' 50 at the 'new' time step. Knowing the 'new' width and the 'new' pressure '(w, p)' and the 'new' fill fraction for each 'tip element' 50 at the 'new' time step, we can then update the perimeter 46*a* of the fracture footprint 46 in response to the newly calculated 'new' width and 'new' pressure (w, p) and 'new' fill fraction at each 'tip element' 50 at the 'new' time step. We can then check for global convergence of the 'fill fractions' by comparing the newly calculated 'new' fill fractions with the previously known 'current' fill fractions. If the difference between the newly calculated 'new' fill fractions and the previously known 'current' fill fractions is not less than a value 'TOL', in another iteration at the same 'new' time step, it is necessary to recalculate a 'new' width and a 'new' pressure and a 'new' fill fraction. If the difference between the newly calculated 'new' fill fractions and the previously known 'current' fill fractions is less than a particular value 'TOL', update the time step to 'another new' time step and repeat the above process. The following discussion with reference to FIGS. 15, 16, 17, and 18 will describe the above referenced 'VOF method' which represents a basic construction of the 'VOF software' 80** in accordance with the present invention.

In FIG. 15, in the first step 86, the following data is given: the current time, the current (or latest) fill fraction, the current pressure, and the current width at each 'tip element' 50. In the second step 80*a*, update the time step. In the third step 80*b*, recall that the MVOF scheme will update the Fill Fraction (or 'F' field) only at 'tip elements' 50. Therefore, in the third step 80*b*, initialize the fill fractions at all 'tip elements' 50 for the next iteration of VOF equations. In the fourth step 80*c*, the VOF iteration loop begins. In the fifth step 80*d*, solve for the width and the pressure at each 'tip element' 50 given the latest Fill Fraction (F) data at all 'tip elements' 50, using elasticity and fluid flow equations. In the sixth step 80*e*, update all Fill Fractions for each 'tip element' 50 using the Fill Fraction mass balance integral equation. In the seventh step 80*f*, check for convergence of Fill Fractions (F). If no (there is no such convergence between the previous and current fill fractions), go back to step 80*c* for the same time step. If yes (there is convergence between the previous and current fill fractions), in step 80*g*, update the time step, and go back to step 80*a* to repeat the process.

In FIG. 16, the following equations represent each of the steps 86 through 80*g* which are set forth in FIG. 15:

Given current time, fill fraction, pressure and width at each tip element—step 86

Given $t_k$, $F_k$, $p_k$, $w_k$

Update Time Step—step 80*a*

$$t_{k+1}=t_k+\Delta t_k$$

Initialize fill fractions at all elements for next iteration of VOF equations—step 80*b*

$$\text{Initialize } F_{k+1}^{(1)}=F_k$$

VOF Iteration Loop—step 80*c*

$$VOF \text{ Iteration } F_{k+1}^{(j)},\ j=1,\ldots$$

Solve for width and pressure at each element given the latest fill fraction data at all element, using elasticity and fluid flow equations—step 80*d*

Solve for (w, p) given current $F_{k+1}^{(j)}$ $$\frac{\partial w(x,y,t)}{\partial t}=\nabla\cdot(wk(w,|\nabla p|)\nabla p)+Q\delta-2L(t,t_0(x,y))$$

$$p(x,y,t)-\sigma_c=\int_{\Omega(t)}C(x,y;\xi,\eta)w(\xi,\eta,t)d\xi d\eta$$

Update fill fractions for each element using fill fraction mass balance integral equation—step 80*e*

Update $F_{k+1}^{(j+1)}$ for each tip element $$F_{k+1}^{(j+1)}=F_k-\frac{\Delta t_k}{A_c}\int_{\Gamma_e(t)}\underline{v}_{k+1}^{(j)}\cdot\underline{n}dl$$

Check for convergence of fill fractions—step 80*f*

Is $$\left\|F_{k+1}^{(j+1)}-F_{k+1}^{(j)}\right\|<TOL?$$

Next Time step—step 80*g*

Referring to FIGS. 17 and 18, a second embodiment of the 'VOF software' 80 in accordance with the present invention is illustrated. This second embodiment is known as the 'Full VOF' or (FVOF) method. FIGS. 17 and 18 are intended to be read concurrently together, FIG. 17 including the steps of the (FVOF) method, FIG. 18 including the equations adapted for implementing each of the steps of the (FVOF) method of FIG. 17.

In FIG. 17, in the first step 86, the following data is given: the current time, the current (or latest) fill fraction, the current pressure, and the current width at each 'tip element' 50. In the second step 80h, update the time step. In the third step 80*i*, the FVOF scheme will update the Fill Fraction (or 'F' field) only at 'tip elements' 50. Therefore, in the third step 80*i*, initialize the fill fractions at all 'tip elements' 50 for the next iteration of VOF equations. In the fourth step 80*j*, the VOF iteration loop begins. In the fifth step 80*k*, solve for the width and the pressure at each 'tip element' 50 given the latest Fill Fraction (F) data at all 'tip elements' 50, using elasticity and the integrated form of fluid flow equations. In the sixth step 80L, update all Fill Fractions for each 'tip element' 50 using the integrated form of fluid flow equations. In the seventh step 80M, check for convergence of Fill Fractions (F). If no (there is no such convergence between the previous and current fill fractions), go back to step 80*j* for the same time step. If yes (there is convergence between the previous and current fill fractions), in step 80N, update the time step, and go back to step 80*h* to repeat the process.

In FIG. 18, the following equations represent each of the steps 86 through 80*g* which are set forth in FIG. 17:

Given current time, fill fraction, pressure and width at each tip element—step 86

Given $t_k$, $F_k$, $p_k$, $w_k$

Update Time Step—step 80*h*

$$t_{k+1}=t_k+\Delta t_k$$

Initialize fill fractions at all element for next iteration of VOF equations—step 80*i*

$$\text{Initialize } F_{k+1}^{(1)}=F_k$$

VOF Iteration Loop—step 80*j*

$$VOF \text{ Iteration } F_{k+1}^{(j)},\ j=1,\ldots$$

Solve for width and pressure at each element given latest fill fraction data at all elements, using elasticity and integrated form of fluid flow equations—step 80*k*

Solve for (w, p) given current $F_{k+1}^{(j)}$ $$\frac{\partial(Fw(x,y,t))}{\partial t}=\frac{1}{A_e}\int_{\Gamma_e(t)}(wk(w,|\nabla p|)\nabla p)\cdot\underline{n}dl+\frac{Q(t)}{A_e}-G_e(f,t,t_0^e)$$

$$p(x,y,t)-\sigma_c=\int_{\Omega(t)}C(x,y;\xi,\eta)w(\xi,\eta,t)d\xi d\eta$$

Update fill fractions for each element using integrated form of fluid flow equations—step 80L Update $F_{k+1}^{(j+1)}$ for each tip element $$w_{k+1}F_{k+1}^{(j+1)}=w_kF_k-\frac{\Delta t_k}{A_e}\int_{\Gamma_e(t)}\underline{v}_{k+1}^{(j)}\cdot\underline{n}dl-G_e\left(F_{k+1}^{(j+1)},t,t_0^e\right)$$

Check for convergence of fill fractions—step 80M

Is $$\left\|F_{k+1}^{(j+1)} - F_{k+1}^{(j)}\right\| < TOL?$$

Go to next time step—step 80N

Figure 19:
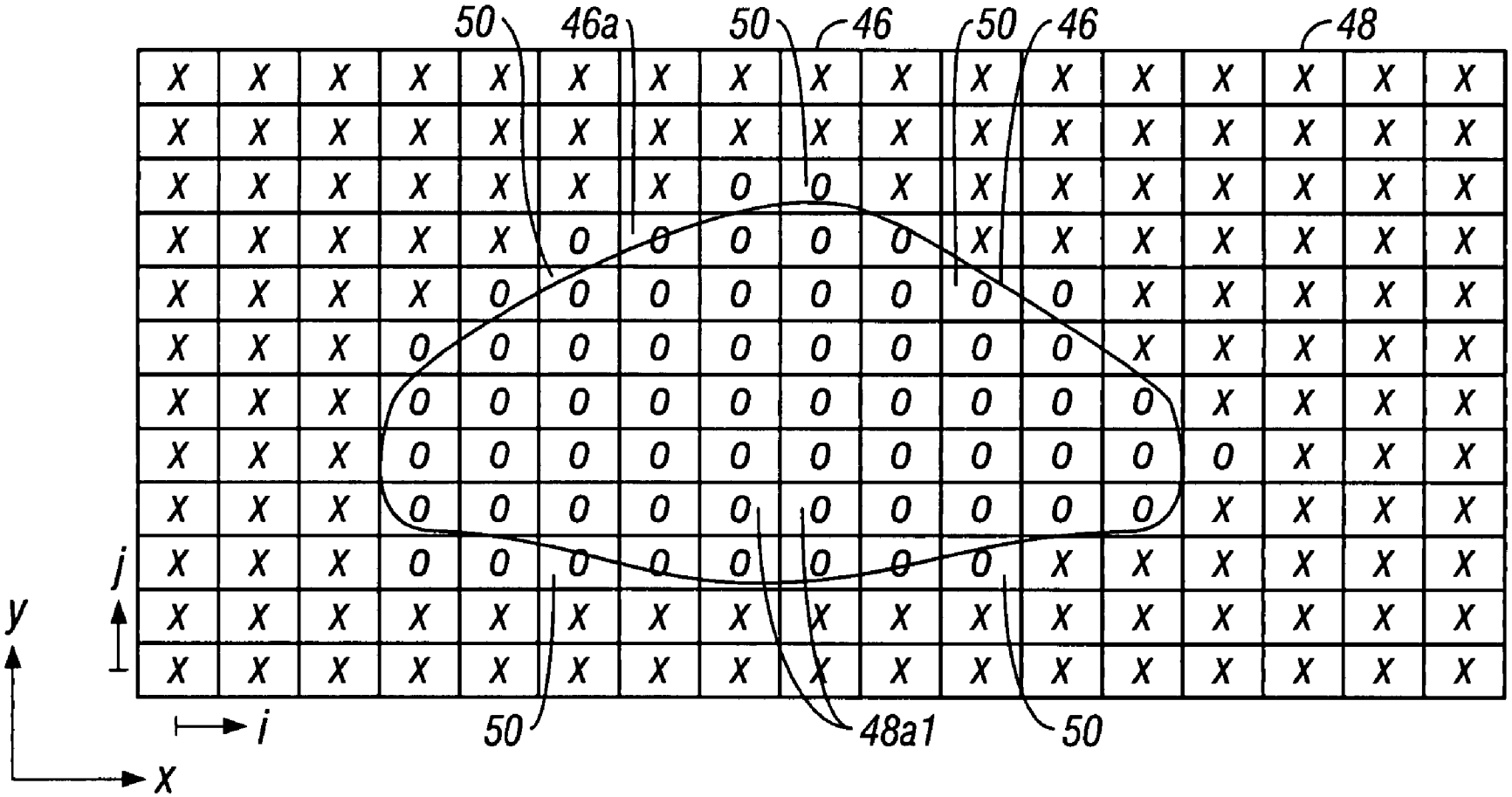
FIG. 19 illustrates another example of the mesh comprised of a plurality of grid cells which overlays a fracture footprint similar to that which is shown in FIG. 7, this example of FIG. 19 being used to illustrate how a Fill Fraction Matrix Output is generated by the recorder or display device of the computer system of FIG. 11.

Referring to FIG. 19, a mesh 48 (consisting of a plurality of active grid cells 48*a*1 and inactive grid cells 48*a*2) overlays the 'model of the fracture footprint' 46 of FIG. 10. In FIG. 19, the VOF software 80 of the present invention, when executed by the processor 72*a* of the computer system 72 of FIG. 11, will update the 'model of the fracture footprint' 46 by updating the location of the perimeter 46*a* of the footprint 46 inside each of the 'tip elements' 50 over a series of time steps. Recall that a 'tip element' 50 is an active grid cell 48*a*1 (which overlays the footprint) that is intersected by the perimeter 46*a* of the footprint 46. The active grid cells 48*a*1 which are not intersected by the perimeter 46*a* are deemed to be fully occupied by fracturing fluid (100%), and thus they have a Fill Fraction of 1 (F=1). The 'tip elements' 50 are deemed not to be fully occupied by fracturing fluid 62, although some fracturing fluid 62 does occupy the 'tip elements' 50 (<100%), and, thus, they have a Fill Fraction of less than 1 (F<1). The inactive grid cells 48*a*2 are not disposed within the perimeter 46*a* of the footprint 46, thus, they are deemed not to be occupied by any amount of fracturing fluid 62 and, thus, they have a Fill Fraction of 0 (F=0). When the VOF software 80 calculates the Fill Fractions (F) at each of the 'tip elements' 50 in FIG. 19, a Fill Fraction Matrix Output 82 will be generated by the processor 72*a* of the computer system 72, the Fill Fraction Matrix Output 82 being recorded or displayed on the recorder or display device 72*c* in FIG. 11.

Referring to FIG. 20, an example of a Fill Fraction Matrix Output 82, which can be recorded or displayed on the recorder or display device 72*c* of FIG. 11, is illustrated in FIG. 20. In the Fill Fraction Matrix Output 82 of FIG. 20, note that the Fill Fractions (F) at each of the 'tip elements' 50 are less than 1 (F<1), but the Fill Fractions (F) at each of the active grid cells 48*a*1 which are not intersected by the perimeter 46*a* of the footprint 46 each have a Fill Fraction of 1 (F=1). However, the Fill Fractions (F) at each of the inactive grid cells 48*a*2 are equal to zero (F=0).

A functional description of the operation of the present invention will be set forth in the following paragraphs with reference to FIGS. 1 through 20 of the drawings.

A fracturing fluid 22 of FIG. 2 will be pumped down a wellbore 12 by the pump trucks 30 of FIG. 4, the fracturing fluid 22 entering the perforations 18 in the formation 20 for the purpose of fracturing an Earth formation 20 in accordance with a pumping schedule 24, and, responsive thereto, oil and other hydrocarbon deposits 26 will be produced from the wellbore 12 at a certain production rate 28 in FIG. 3 in barrels per day. In FIG. 4, a plurality of fracture footprints 32, 34, 36, and 38 are produced in the formation 20, a first fracture footprint 32 being created at time t1, a second fracture footprint 34 being created at time t2, a third fracture footprint 36 being created at time t3, and a fourth fracture footprint 38 being created at time t4 in the Earth's formation 20. In FIG. 6, a better view of a fracture footprint 46 is illustrated, the footprint 46 having a length 'L' and a width 'w' and a height 'H' as shown in FIG. 5, the footprint 46 having a cross section 44 as shown in FIG. 6. In FIG. 10, when the formation is fractured in accordance with a pumping schedule 60, the fracture footprint 46 is created. Sensors placed in the formation near the fracture footprint 46 include tiltmeter sensors 66 and micro-seismic data sensors 64. The sensors will generate output signals including a tiltmeter data output signal 66*a* and a micro-seismic data output signal 64*a*. The pumping schedule 60 will generate its own output signal, the pumping schedule output signal 60*a*. These output signals 60*a*, 66*a*, and 64*a* will be synchronized with the times (e.g., 100 min, 200 min, . . . , etc.) in the pumping schedule 60 via the 'time line merging' block 68 to produce a 'time line merged pumping schedule, tiltmeter data, and micro-seismic data' output signal 70 which will be provided as 'input data' to the computer system 72 of the truck 74, the truck 74 being a well monitoring truck 74 or a 'FracCAT vehicle' having PC or other computer equipment (see block 74 in FIG. 12). In FIG. 11, the 'time line merged pumping schedule, tiltmeter data, and micro-seismic data' output signal 70 is provided as 'input data' to the computer system 72. The processor 72*a* is adapted to execute the software stored in the memory or program storage device 72*b* of the computer system in response to the 'input data', the software including: a hydraulic fracturing software 76 which includes a hydraulic fracturing simulator engine 78 which further includes a 'VOF software' 80 in accordance with the present invention. The 'VOF software' 80 in accordance with the present invention is discussed below with reference to FIGS. 13 through 18 of the drawings. When the processor 72*a* executes the software stored in the memory or program storage device 72*b* of the computer system 72 of FIG. 11 (where the software includes a hydraulic fracturing software 76 which includes a hydraulic fracturing simulator engine 78 which further includes a 'VOF software' 80 of the present invention), a Fill Fraction Matrix Output 82 is recorded or displayed on the recorder or display device 72*c* of the computer system 72. An example of a Fill Fraction Matrix Output 82 is shown in FIG. 20. In FIGS. 13 and 14, when the 'time line merged pumping schedule, tiltmeter data, and micro-seismic data' output signal 70 of FIG. 13 is provided as 'input data' to the computer system 72, certain 'other input data' 86 of FIG. 14 is provided to the 'VOF software' 80 of the present invention, that 'other input data' 86 including: the current time at a current time step (t1), a latest fill fraction (F) associated with each of the 'tip elements' 50 as shown in FIG. 7, a current pressure (p) associated with each of the 'tip elements' 50, and a current width (w) associated with each of the 'tip elements' 50. In FIG. 14, the 'VOF software' 80 of the present invention is now ready to be executed by the processor 72*a* of the computer system 72 in FIG. 11 in response to the 'other input data' 86 of FIG. 14 which includes: the current time at a current time step (t1), a latest fill fraction (F) associated with each of the 'tip elements' 50 as shown in FIG. 7, a current pressure (p) associated with each of the 'tip elements' 50, and a current width (w) associated with each of the 'tip elements' 50. When the 'VOF software' 80 is executed by the processor 72*a* using the 'other input data' 86, a fracture footprint 46 is modeled, and then the mesh 48 of FIG. 7 will be overlayed over the fracture footprint 46 in the manner shown in FIG. 7 thereby defining a plurality of grid cells 48*a*, the plurality of grid cells 48*a* including: active grid cells 48*a*1 and inactive grid cells 48*a*2. The active grid cells 48*a*1 include: 'active grid cells 48*a*1 which are intersected by the perimeter 46*a* of the footprint 46 (where the active grid cells 48*a*1 that are intersected by the perimeter 46*a* are called 'tip elements' such as 'tip elements' 50)' and 'active grid cells 48*a*1 which are not intersected by the perimeter 46*a* (such as active grid cell 52)'. The 'tip elements' 50 have a fill fraction (F) of less than 1 (F<1). The active grid cells 48*a*1 which are not intersected by the perimeter 46*a* have a fill fraction (F) of 1 (F=1). The inactive grid cells 48*a*2 have a fill fraction of 0 (F=0), at least, in the case as shown in FIG. 8 where a fluid is not deemed to be present outside the perimeter 46*a*. When the 'VOF software' 80 is executed by the processor 72*a* using the 'other input data' 86, and after the mesh 48 of FIG. 7 is overlayed over the fracture footprint 46 in the manner shown in FIG. 7, the position of the perimeter 46*a*, disposed within each of the plurality of active grid cells 48*a*1 which are intersected by the perimeter 46*a* of the fracture footprint 46 (such as the plurality of 'tip elements' 50 shown in FIG. 7), is continuously updated.

When the position of the perimeter 46*a*, disposed within each of the 'tip elements' 50 of FIG. 7, is continuously updated by the 'VOF software' 80, the following 'additional steps' are practiced by the 'VOF software' 80 of the present invention when the processor 72*a* of the computer system 72 executes the 'VOF software' 80 of the present invention.

In accordance with a first embodiment of the present invention, the 'VOF software' 80 shown in FIGS. 17 and 18, called the 'Full VOF' or 'FVOF' approach, is executed by the processor 72*a* of the computer system 72 shown in FIG. 11. In FIG. 14, the 'VOF software' 80 receives, as 'input data', the current time, the current fill fraction, the current pressure, and the current width in each 'tip element' 50. The 'additional steps' practiced by the FVOF approach associated with the 'VOF software' 80 is illustrated in FIGS. 17 and 18.

In FIGS. 17 and 18, read FIGS. 17 and 18 jointly during this portion of the specification. In response to the 'input data' including the current time, the current fill fraction, the current pressure, and the current width in each 'tip element' 50 (that is, in response to the 'input data' including $t_k$, $F_k$, $p_k$, $w_k$), a first step includes: 'update time step' (step 80*h*); do this by incrementing a previous 'first time step' to a 'second time step', where the following equation represents the 'update time step' step 80*h*: $t_{k+1}=t_k+\Delta t_k$. A second step includes: 'Initialize fill fractions at all elements for the next iteration of VOF equations' (step 80*i*); and the following equation represents this second step: $F_{k+1}^{(1)}=F_k$. A third step starts the VOF iteration loop (step 80*j*), where the following notation represents the 'current fill fraction' at iteration (j): $F_{k+1}^{(j)}$[where j=1, . . . , N, where N represents the Nth VOF iteration] (step 80M). A fourth step includes: 'Solve for the width and pressure at each tip element 50 given the 'current fill fraction' [at iteration (j)] $F_{k+1}^{(j)}$ at all tip elements 50, using the elasticity and integrated form of fluid flow equations' (step 80*k*); the following equations represent this fourth step: solve for (w, p) given 'current fill fraction' data $F_{k+1}^{(j)}$ at all tip elements 50, where $$\frac{\partial(Fw(x,y,t))}{\partial t}=\frac{1}{A_e}\int_{\Gamma_e(t)}(wk(w,|\nabla p|)\nabla p)\cdot\underline{n}dl+\frac{Q(t)}{A_e}-G_e(f,t,t_0^e),$$

and $$p(x,y,t)-\sigma_c=\int_{\Omega(t)}C(x,y;\xi,\eta)w(\xi,\eta,t)d\xi d\eta.$$

A fifth step includes: 'Update fill fractions for each tip element 50 using the integrated form of fluid flow equations' (step 80L); the following equation represents the integrated form of fluid flow equations of this fifth step (80L):

Update fill fractions by determining the 'latest fill fraction'

$$[\text{at iteration } (j+1)]\,F_{k+1}^{(j+1)}$$

for each tip element (step 80L), as follows:

$$w_{k+1}F_{k+1}^{(j+1)}=w_kF_k-\frac{\Delta t_k}{A_e}\int_{\Gamma_e(t)}\underline{v}_{k+1}^{(j)}\cdot\underline{n}dl-G_e(F_{k+1}^{(j+1)},t,t_0^e).$$

A sixth step includes: 'Check for convergence of fill fractions' (step 80M); the following question represents this sixth step: Is $$\|F_{k+1}^{(j+1)}-F_{k+1}^{(j)}\|<TOL?$$

Recalling that the 'latest fill fraction' [at iteration (j+1)] is denoted by $$F_{k+1}^{(j+1)}$$

(determined during step 80L) and the 'current fill fraction' [at iteration (j)] is denoted by $$F_{k+1}^{(j)}$$

(which is a part of the 'input data'), check for 'convergence' by determining if $$\|F_{k+1}^{(j+1)}-F_{k+1}^{(j)}\|$$

is 'less than' a 'tolerance' (TOL). If $$\|F_{k+1}^{(j+1)}-F_{k+1}^{(j)}\|$$

is not 'less than' a 'tolerance' (TOL), the 'latest fill fraction'

$$F_{k+1}^{(j+1)}$$

now becomes the 'current fill fraction'

$$F_{k+1}^{(j+1)},$$

and go back to the start of the VOF iteration loop (VOF iteration loop 80*j*), and repeat steps 80*k*, 80L, and 80M. However, if $$\|F_{k+1}^{(j+1)}-F_{k+1}^{(j)}\|$$

is 'less than' a 'tolerance' (TOL), using $$F_{k+1}^{(j+1)}$$

as the 'current fill fraction', go back to step 80*h* and 'update the time step' from a 'second time step' to a 'third time step', and repeat steps 80*i*, 80*j*, 80*k*, 80L, and 80M for the 'third time step'. However, the fill fraction $$F_{k+1}^{(j+1)},$$

which was previously determined during step 80L, is recorded for purposes of determining the Fill Fraction Matrix Output 82 of FIGS. 11 and 20.

In accordance with a second embodiment of the present invention, the 'VOF software' 80 shown in FIGS. 15 and 16, called the 'Marker VOF' or 'MVOF' approach, is executed by the processor 72*a* of the computer system 72 shown in FIG. 11. In FIG. 14, the 'VOF software' 80 receives, as 'input data', the current time, the latest fill fraction, the current pressure, and the current width in each 'tip element' 50. The 'additional steps' practiced by the MVOF approach associated with the 'VOF software' 80 is illustrated in FIGS. 15 and 16.

In FIGS. 15 and 16, read FIGS. 15 and 16 jointly during this portion of the specification. In response to the 'input data' including the current time, the current fill fraction, the current pressure, and the current width in each 'tip element' 50 (that is, in response to the 'input data' including $t_k$, $F_k$, $p_k$, $w_k$), a first step includes: 'update time step' (step 80*a*); do this by incrementing a previous 'first time step' to a 'second time step', where the following equation represents the 'update time step' step 80*h*: $t_{k+1}=t_k+\Delta t_k$. A second step includes: 'Initialize fill fractions at all elements for the next iteration of VOF equations' (step 80*b*); and the following equation represents this second step: $F_{k+1}^{(1)}=F_k$. A third step starts the VOF iteration loop (step 80*c*), where the following notation represents the 'current fill fraction' at iteration (j): $F_{k+1}^{(j)}$ [where j=1, . . . , N, where N represents the Nth VOF iteration] (step 80*c*). A fourth step includes: 'Solve for the width and pressure at each tip element 50 given the 'current fill fraction' data $F_{k+1}^{(j)}$ at all tip elements 50, using the elasticity and fluid flow equations' (step 80*d*); the following equations represent this fourth step: solve for (w, p) given 'current fill fraction' data $F_{k+1}^{(j)}$, where $$\frac{\partial w(x, y, t)}{\partial t} = \nabla \cdot (wk(w, |\nabla p|)\nabla p) + Q\delta - 2L(t, t_0(x, y))$$

$$p(x, y, t) - \sigma_c = \int_{\Omega(t)} C(x, y; \xi, \eta) w(\xi, \eta, t) d\xi d\eta.$$

A fifth step includes: 'Update fill fractions for each tip element 50 using a fill fraction mass balance integral equation' (step 80*e*); the following equation represents the fill fraction mass balance equation of this fifth step (80*e*):

Update fill fractions by determining the 'latest fill fraction'

$$[\text{at iteration } (j+1)]F_{k+1}^{(j+1)}$$

for each tip element (step 80*e*), as follows:

$$F_{k+1}^{(j+1)} = F_k - \frac{\Delta t_k}{A_e} \int_{\Gamma_e(t)} \underline{v}_{k+1}^{(j)} \cdot \underline{n} dl.$$

A sixth step includes: 'Check for convergence of fill fractions' (step 80*f*); the following question represents this sixth step: Is $$\|F_{k+1}^{(j+1)} - F_{k+1}^{(j)}\| < TOL?$$

Recalling that the 'latest fill fraction' [at iteration (j+1)] is denoted by $$F_{k+1}^{(j+1)}$$

(determined during step 80*e*) and the 'current fill fraction' [at iteration (j)] is denoted by $$F_{k+1}^{(j)}$$

(which is a part of the 'input data'), check for 'convergence' by determining if $$\|F_{k+1}^{(j+1)} - F_{k+1}^{(j)}\|$$

is 'less than' a 'tolerance' (TOL). If $$\|F_{k+1}^{(j+1)} - F_{k+1}^{(j)}\|$$

is not 'less than' a 'tolerance' (TOL), the 'latest fill fraction'

$$F_{k+1}^{(j+1)}$$

now becomes the 'current fill fraction'

$$F_{k+1}^{(j+1)},$$

and go back to the start of the VOF iteration loop (VOF iteration loop 80*c*), and repeat steps 80*d*, 80*e*, and 80*f*. However, if $$\|F_{k+1}^{(j+1)} - F_{k+1}^{(j)}\|$$

is 'less than' a 'tolerance' (TOL), using $$F_{k+1}^{(j+1)}$$

as the 'current fill fraction', go back to step 80*a* and 'update the time step' from a 'second time step' to a 'third time step', and repeat steps 80*b*, 80*c*, 80*d*, 80*e*, and 80*f* for the 'third time step'. However, the fill fraction $$F_{k+1}^{(j+1)},$$

which was previously determined during step 80*e*, is recorded for purposes of determining the Fill Fraction Matrix Output 82 of FIGS. 11 and 20.

When the fill fractions $$F_{k+1}^{(j+1)}$$

are determined during step 80L in the FVOF approach of FIGS. 17 and 18 and step 80*e* in the MVOF approach of FIGS. 15 and 16 in the manner set forth above, the Fill Fraction Matrix Output 82 of FIGS. 11 and 20 will be generated by the recorder or display device 72*c*. The Fill Fraction Matrix Output 82 of FIG. 20 includes the Fill Fractions $$F_{k+1}^{(j+1)}$$

associated with each of the active grid cells 48*a*1 and each of the inactive grid cells 48*a*2 in the mesh 48 which overlays the fracture footprint 46 in FIG. 19.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of continuously updating a perimeter of a fracture footprint, said fracture footprint having a plurality of tip elements, comprising the steps of:

(a) updating a fill fraction for each tip clement of said plurality of tip elements by using the following equation:

$$w_{k+1}F_{k+1}^{(j+1)} = w_k F_k - \frac{\Delta t_k}{A_e}\int_{\Gamma_e(t)} \underline{v}_{k+1}^{(j)} \cdot \underline{n}\,dl - G_e\left(F_{k+1}^{(j+1)}, t, t_0^e\right)$$

wherein $w_k$ is the fracture width at time $t_k$, $w_{k+1}$ is the fracture width at time $t_{k+1}$, $F_k$ is the fill fraction at time $t_k$, $F_{k+1}^{(j+1)}$ is the fill fraction at time $t_{k+1}$ and iteration (j+1), $\Delta t_k$ is the time step at time $t_k$, n is the local unit normal to the fracture boundary, $\Gamma_e(t)$, at tip element a and time t, $v_{k+1}^{(j)}$ is the local fluid front velocity at time $t_{k+1}$ and iteration (f), $G_e(F_{k+1}^{(j+1)},t,t_0^e)$ is an integrated sink (or leakoff) term over the possibly partially filled tip element e, $t_0^e$ is the trigger time at which the fluid first enters tip element e, t is the current time, and $A_e$ is the area of the rectangular tip element e.

2. The method of claim 1, wherein the updating step (a) comprises the steps of:

(a1) receiving input data including an old fill fraction (F1) associated with the tip elements at an old time step (t1), an old pressure (p1) associated with the tip elements at the old time step, and an old width (w1) associated with the tip elements at the old time step; and (a2) incrementing the old time step (t1) to a new time step (t2).

3. The meted of claim 2, wherein the updating step (a) further comprises the step of:

(a3) solving for a new width (w2) and a new pressure (p2) associated with the tip elements at the new time step (t2) in response to the input data.

4. The method of claim 3, wherein the updating step (a) further comprises the step of:

(a4) solving for a current new fill fraction (F2) associated with the tip elements at the new time step (t2) by using said equation:

$$w_{k+1}F_{k+1}^{(j+1)} = w_k F_k - \frac{\Delta t_k}{A_e}\int_{\Gamma_e(t)} \underline{v}_{k+1}^{(j)} \cdot \underline{n}\,dl - G_e\left(F_{k+1}^{(j+1)}, t, t_0^e\right)$$

wherein $w_k$ is the fracture width at time $t_k$, $w_{k+1}$ is the fracture width at time $t_{k+1}$, $F_k$ is the fill fraction at time $t_k$, $F^{k+1(j+1)}$ is the fill fraction at time $t_{k+1}$ and iteration (j+1), $\Delta t_k$ is the time step at time $t_k$, n is the local unit normal to the fracture boundary, $\Gamma_e(t)$, at tip element a and time t, $v_{k+1}^{(j)}$ is the local fluid front velocity at time $t_{k+1}$ and iteration (f), $G_e(F_{k+1}^{(j+1)},t,t_0^e)$ is an integrated sink (or leakoff) term over the possibly partially filled tip element e, $t_0^e$ is the trigger time at which the fluid first enters tip element e, t is the current time, and $A_e$ is the area of the rectangular tip element e.

5. The method of claim 4, further comprising:

(b) iterating said equation by updating the current new fill fraction (F2) (iteration j) to determine a latest new fill fraction (F2) (iteration 'j+1') in response to a latest new value of (w2) (iteration 'j+1') and a latest new value of(p2) (iteration 'j+1').

6. The method of claim 5, further comprising:

(c) determining if a difference between the latest new fill fraction (F2) (iteration 'j+1') and the current new fill fraction (F2) (iteration 'j') is less than a particular tolerance, and repeating steps (b) and (c) on the condition that a difference between the latest new fill fraction (F2) (iteration 'j+1') and the current new fill fraction (F2) (iteration 'j') is not less than the particular tolerance.

7. A program storage device readable by a machine storing a set of instructions executable by the machine to perform method steps for continuously updating a perimeter of a fracture footprint, said fracture footprint having a plurality of tip elements, said method steps comprising:

(a) updating a fill fraction for each tip element of said plurality of tip elements by using the following equation:

$$w_{k+1}F_{k+1}^{(j+1)} = w_k F_k - \frac{\Delta t_k}{A_e}\int_{\Gamma_e(t)} \underline{v}_{k+1}^{(j)} \cdot \underline{n}\, dl - G_e\left(F_{k+1}^{(j+1)}, t, t_0^e\right)$$

wherein $w_k$ is the fracture width at time $t_k$, $w_{k+1}$ is the fracture width at time $t_{k+1}$, $F_k$ is the fill fraction at time $t_k$, $F^{k+1(j+1)}$ is the fill fraction at time $t_{k+1}$ and iteration (j+1), $\Delta t_k$ is the time step at time $t_k$, n is the local unit normal to the fracture boundary, $\Gamma_e(t)$, at tip element a and time t, $v_{k+1}^{(j)}$ is the local fluid front velocity at time $t_{k+1}$ and iteration (f), $G_e(F_{k+1}^{(j+1)},t,t_0^e)$ is an integrated sink (or leakoff) term over the possibly partially filled tip element e, $t_0^e$ is the trigger time at which the fluid first enters tip element e, t is the current time, and $A_e$ is the area of the rectangular tip element e.

8. The program storage device of claim 7, wherein the updating step (a) comprises the steps of:

(a1) receiving input data including an old fill fraction (F1) associated with the tip elements at an old time step (t1), an old pressure (p1) associated wit the tip elements at the old time step, and an old width (w1) associated with the tip elements at the old time step; and (a2) incrementing the old time step (t1) to a new time step (t2).

9. The program storage device of claim 8, wherein the updating step (a) further comprises the step of:

(a3) solving for a new width (w2) and a new pressure (p2) associated with the tip elements at the new time step (t2) in response to the input data.

10. The program storage device of claim 9, wherein the updating step (a) further comprises the step of:

(a4) solving for a current new fill fraction (F2) associated with the tip elements at the new time step (t2) by using said equation:

$$w_{k+1}F_{k+1}^{(j+1)} = w_k F_k - \frac{\Delta t_k}{A_e}\int_{\Gamma_e(t)} \underline{v}_{k+1}^{(j)} \cdot \underline{n}\, dl - G_e\left(F_{k+1}^{(j+1)}, t, t_0^e\right)$$

wherein $w_k$ is the fracture width at time $t_k$, $w_{k+1}$ is the fracture width at time $t_{k+1}$, $F_k$ is the fill fraction at time $t_k$, $F^{k+1(j+1)}$ is the fill fraction at time $t_{k+1}$ and iteration (j+1), $\Delta t_k$ is the time step at time $t_k$, n is the local unit normal to the fracture boundary, $\Gamma_e(t)$, at tip element a and time t, $v_{k+1}^{(j)}$ is the local fluid front velocity at time $t_{k+1}$ and iteration (f), $G_e(F_{k+1}^{(j+1)},t,t_0^e)$ is an integrated sink (or leakoff) term over the possibly partially filled tip element e, $t_0^e$ is the trigger time at which the fluid first enters tip element e, t is the current time, and $A_e$ is the area of the rectangular tip element e.

11. The program storage device of claim 10, further comprising:

(b) iterating said equation by updating the current new fill fraction (F2) (iteration j) to determine a latest new fill fraction (F2) (iteration 'j+1') in response to a latest new value of (w2) (iteration 'j+1') and a latest new value of (p2) (iteration 'j+1').

12. The program storage device of claim 11, further comprising:

(c) determining if a difference between the latest new fill fraction (F2) (iteration 'j+1') and the current new fill fraction (F2) (iteration 'j') is less than a particular tolerance, and repeating steps (b) and (c) on die condition that a difference between the latest new fill fraction (F2) (iteration 'j+1') and the current new fill fraction (F2) (iteration 'j') is not less than the particular tolerance.

13. A system adapted for continuously updating a perimeter of a fracture footprint said fracture footprint having a plurality of tip elements, comprising:

apparatus adapted for updating a fill fraction for each tip element of said plurality of tip elements by using the following equation:

$$w_{k+1}F_{k+1}^{(j+1)} = w_k F_k - \frac{\Delta t_k}{A_e}\int_{\Gamma_e(t)} \underline{v}_{k+1}^{(j)} \cdot \underline{n}\, dl - G_e\left(F_{k+1}^{(j+1)}, t, t_0^e\right)$$

wherein $w_k$ is the fracture width at time $t_k$, $w_{k+1}$ is the fracture width at time $t_{k+1}$, $F_k$ is the fill fraction at time $t_k$, $F^{k+1(j+1)}$ is the fill fraction at time $t_{k+1}$ and iteration (j+1), $\Delta t_k$ is the time step at time $t_k$, n is the local unit normal to the fracture boundary, $\Gamma_e(t)$, at tip element a and time t, $v_{k+1}^{(j)}$ is the local fluid front velocity at time $t_{k+1}$ and iteration (f), $G_e(F_{k+1}^{(j+1)},t,t_0^e)$ is an integrated sink (or leakoff) term over the possibly partially filled tip element e, $t_0^e$ is the trigger time at which the fluid first enters tip element e, t is the current time, and $A_e$ is the area of the rectangular tip element e.

14. A method adapted fir continuously updating a perimeter of a fracture footprint created in an Earth formation when a fracturing fluid fractures the formation penetrated by a wellbore, a mesh overlaying the fracture footprint defining a plurality of tip elements, comprising the steps of:

(a) receiving input data including an old fill fraction F1 associated with the tip elements at an old time step 't1', an old pressure 'p1' associated with the tip elements at the old time step, and an old width 'w1' associated with the tip elements at the old time step;

(b) incrementing the old time 't1' to anew time step 't2';

(c) solving for a new width 'w2' and a new pressure 'p2' associated with the tip elements at the new time step 't2' in response to the input data;

(d) solving for a current new fill fraction 'F2' associated with the tip elements at the new time step 't2' by using the following equation:

$$w_{k+1}F_{k+1}^{(j+1)} = w_k F_k - \frac{\Delta t_k}{A_e}\int_{\Gamma_e(t)} \underline{v}_{k+1}^{(j)} \cdot \underline{n}\, dl - G_e\left(F_{k+1}^{(j+1)}, t, t_0^e\right)$$

wherein $w_k$ is the fracture width at time $t_k$, $w_{k+1}$ is the fracture width at time $t_{k+1}$, $F_k$ is the fill fraction at time $t_k$, $F^{k+1(j+1)}$ is the fill fraction at time $t_{k+1}$ and iteration (j+1), $\Delta t_k$ is the time step at time $t_k$, n is the local unit normal to the fracture boundary, $\Gamma_e(t)$, at tip element a and time t, $v_{k+1}^{(j)}$ is the local fluid front velocity at time $t_{k+1}$ and iteration (f), $G_e(F_{k+1}^{(j+1)},t,t_0^e)$ is an integrated sink (or leakoff) term over the possibly partially filled tip element e, $t_0^e$ is the trigger time at which the fluid first enters tip element e, t is the current time, and $A_e$ is the area of the rectangular tip element e;

(a) iterating the above equation by updating the current new fill fraction 'F2' (iteration 'j') to determine a latest new fill fraction 'F2' (iteration 'j+1') in response to a latest new value of 'w2' (iteration 'j+1') and a latest new value of 'p2' (iteration 'j+1'), (f) determining if the difference between the latest new fill fraction 'F2' (iteration 'j+1') and the current new fill fraction 'F2' (iteration 'j') is less than a particular tolerance;

(g) repeating steps (e) and (f) when the difference between the latest new fill fraction 'F2' (iteration 'j+1') and the current new fill fraction 'F2' (iteration 'j') is not less than the particular tolerance; and (h) when the difference between the latest new fill fraction 'F2' (iteration 'j+1') and the current new fill fraction 'F2' (iteration 'j') is less than the particular tolerance, proceed to the next time step 't3' and repeat steps (a) through (g), where time 't2' replaces time 't1' and time 't3' replaces time 't2', and similarly for width and pressure values where width 'w2' replaces width 'w1', pressure 'p2' replaces pressure 'p1', and width 'w3' replaces width 'w2', pressure 'p3' replaces pressure 'p2'.

15. A program storage device readable by a machine storing a set of instructions executable by the machine to perform method steps for continuously updating a perimeter of a fracture footprint created in an Earth formation when a fracturing fluid fractures the formation penetrated by a wellbore, a mesh overlaying the fracture footprint defining a plurality of tip elements, said method step comprising:

(a) receiving input data including an old fill fraction F1 associated with the tip elements at an old time step 't1', an old pressure 'p1' associated with the tip elements at the old time step, and an old width 'w1' associated with the tip elements at the old time step;

(b) incrementing the old time 't1' to a new time step 't2';

(c) solving for a new width 'w2' and a new pressure 'p2' associated with the tip elements at the new time step 't2' in response to the input data;

(d) solving for a current new fill fraction 'F2' associated with the tip elements at the new time step 't2' by using the following equation:

$$w_{k+1}F_{k+1}^{(j+1)} = w_k F_k - \frac{\Delta t_k}{A_e}\int_{\Gamma_e(t)} v_{k+1}^{(j)} \cdot \underline{n}\, dl - G_e\left(F_{k+1}^{(j+1)}, t, t_0^e\right)$$

wherein $w_k$ is the fracture width at time $t_k$, $w_{k+1}$ is the fracture width at time $t_{k+1}$, $F_k$ is the fill fraction at time $t_k$, $F^{k+1(j+1)}$ is the fill fraction at time $t_{k+1}$ and iteration (j+1), $\Delta t_k$ is the time step at time $t_k$, n is the local unit normal to the fracture boundary, $\Gamma_e(t)$, at tip element a and time t, $v_{k+1}^{(j)}$ is the local fluid front velocity at time $t_{k+1}$ and iteration (f), $G_e(F_{k+1}^{(j+1)},t,t_0^e)$ is an integrated sink (or leakoff) term over the possibly partially filled tip element e, $t_0^e$ is the trigger time at which the fluid first enters tip element e, t is the current time, and $A_e$ is the area of the rectangular tip element e;

(e) iterating the above equation by updating the current new fill fraction 'F2' (iteration 'j') to determine a latest new fill fraction 'F2' (iteration 'j+1') in response to a latest new value of 'w2' (iteration 'j+1') and a latest new value of 'p2' (iteration 'j+1'), (f) determining if the difference between the latest new fill fraction 'F2' (iteration 'j+1') and the current new fill fraction 'F2' (iteration 'j') is less than a particular tolerance;

(g) repeating steps (e) and (f) when the difference between the latest new fill fraction 'F2' (iteration 'j+1') and the current new fill fraction 'F2' (iteration 'j') is not less than the particular tolerance; and (h) when the difference between the latest new fill fraction 'F2' (iteration 'j+1') and the current new fill fraction 'F2' (iteration 'j') is less than the particular tolerance, proceed to the next time step 't3' and repeat steps (a) through (g), where time 't2' replaces time 't1' and time 't3' replaces time 't2', and similarly for width and pressure values where width 'w2' replaces width 'w1', pressure 'p2' replaces pressure 'p1', and width 'w3' replaces width 'w2', pressure 'p3' replaces pressure 'p2'.

* * * * *